US007748241B2

(12) United States Patent
Knight et al.

(10) Patent No.: US 7,748,241 B2
(45) Date of Patent: Jul. 6, 2010

(54) TUBULAR CUT PILE KNIT FABRIC FOR PAINT ROLLER COVERS

(75) Inventors: John C. Knight, North, SC (US); Daniel L. Sinykin, Bayside, WI (US)

(73) Assignee: Seamless Technologies, LLC, Janesville, WI (US)

( * ) Notice: Subject to any disclaimer, the term of this patent is extended or adjusted under 35 U.S.C. 154(b) by 178 days.

(21) Appl. No.: 12/116,022

(22) Filed: May 6, 2008

(65) Prior Publication Data

US 2008/0263802 A1 Oct. 30, 2008

Related U.S. Application Data

(63) Continuation-in-part of application No. 11/740,119, filed on Apr. 25, 2007, now Pat. No. 7,503,191, and a continuation-in-part of application No. 12/015,612, filed on Jan. 17, 2008, and a continuation-in-part of application No. 12/100,050, filed on Apr. 9, 2008.

(51) Int. Cl.
*D04B 11/08* (2006.01)

(52) U.S. Cl. ..... 66/191; 66/194

(58) Field of Classification Search ..... 66/191, 66/195, 9 R, 10–12, 190, 194
See application file for complete search history.

(56) References Cited

U.S. PATENT DOCUMENTS

| | | | |
|---|---|---|---|
| 1,791,741 | A | 2/1931 | Moore |
| 1,849,466 | A | 3/1932 | Moore |
| 2,600,955 | A | 6/1952 | Barnes et al. |
| 2,630,619 | A | 3/1953 | Schmidt et al |
| 2,704,877 | A | 3/1955 | Schmidt |
| 2,737,702 | A | 3/1956 | Schmidt et al |
| 2,752,953 | A | 7/1956 | Schmidt |
| 2,920,372 | A | 1/1960 | Sannipoli et al. |
| 2,944,588 | A | 7/1960 | Sannipoli et al. |
| 3,010,867 | A | 11/1961 | Sannipoli et al. |
| 3,181,233 | A | 5/1965 | Sannipoli et al. |
| 3,226,952 | A | 1/1966 | Cassady |
| 3,299,672 | A | 1/1967 | Schmidt |
| 3,732,135 | A | 5/1973 | Ernst et al |
| 3,853,680 | A | 12/1974 | Daniel |
| 3,894,407 | A | 7/1975 | Clingan et al. |
| 3,894,409 | A | 7/1975 | Clingan et al. |
| 3,896,637 | A | 7/1975 | Thore |
| 4,236,286 | A | 12/1980 | Abler et al. |
| 4,245,487 | A | 1/1981 | Schaab et al. |
| 4,415,611 | A | 11/1983 | Yamagata et al. |

(Continued)

*Primary Examiner*—Danny Worrell
(74) *Attorney, Agent, or Firm*—Reinhart Boerner Van Deuren s.c,

(57) ABSTRACT

A tubular knit fabric is disclosed that is manufactured with a pile extending from the outer side thereof and in an extended length, small diameter configuration, the tubular knit pile fabric subsequently being separable into shorter tubular segments that may be secured to paint roller cover cores to produce seamless paint rollers. The knit paint roller cover fabric of the present invention is manufactured in a tubular segment with cut pile segments extending from the outside of the tubular knit paint roller cover fabric. The tubular knit paint roller cover fabric of the present invention is also manufactured in a size that makes it appropriate for installation onto paint roller cover cores.

30 Claims, 16 Drawing Sheets

U.S. PATENT DOCUMENTS

| | | | |
|---|---|---|---|
| 4,466,151 | A | 8/1984 | Barch et al. |
| 4,513,042 | A | 4/1985 | Lumb |
| 4,532,780 | A | 8/1985 | Tilson et al. |
| 4,546,020 | A | 10/1985 | Sakai et al. |
| 4,592,212 | A | 6/1986 | Schmidt |
| 4,592,213 | A | 6/1986 | Tilson et al. |
| 4,692,975 | A | 9/1987 | Garcia |
| 4,798,748 | A | 1/1989 | Kitamura et al. |
| 5,206,968 | A | 5/1993 | Bower et al. |
| 5,294,276 | A | 3/1994 | Linn et al. |
| 5,431,029 | A | 7/1995 | Kuhrau et al. |
| 5,546,768 | A | 8/1996 | Kuhrau et al. |
| 5,572,790 | A | 11/1996 | Sekar |
| 5,577,402 | A | 11/1996 | Kuhrau et al. |
| RE35,526 | E | 6/1997 | Alvarez Garcia |
| 5,685,176 | A | 11/1997 | Kuhrau et al. |
| 5,694,688 | A | 12/1997 | Musch et al. |
| 6,016,670 | A | 1/2000 | Kuhrau et al. |
| 6,151,920 | A | 11/2000 | Schindler et al. |
| 6,151,922 | A | 11/2000 | Shimasaki et al. |
| 6,159,320 | A | 12/2000 | Tams et al. |
| 6,203,648 | B1 | 3/2001 | Barton et al. |
| 6,324,717 | B1 | 12/2001 | Sekar |
| 6,502,779 | B1 | 1/2003 | Jelinek et al. |
| 6,615,490 | B2 | 9/2003 | Polzin |
| 6,685,121 | B1 | 2/2004 | Jelinek et al. |
| 6,766,668 | B2 | 7/2004 | Sinykin |
| 6,902,131 | B1 | 6/2005 | Jelinek et al. |
| 6,918,552 | B2 | 7/2005 | Jelinek et al. |
| 6,929,203 | B1 | 8/2005 | Jelinek et al. |
| 6,993,941 | B2 | 2/2006 | Yamaguchi |
| 2002/0042331 | A1 | 4/2002 | Fortner et al. |
| 2002/0091051 | A1 | 7/2002 | Sekar |
| 2002/0112810 | A1 | 8/2002 | Polzin et al. |
| 2003/0213083 | A1 | 11/2003 | Yamaguchi |
| 2007/0056132 | A1 | 3/2007 | Yamaguchi et al. |

TUBULAR CUT PILE KNIT FABRIC FOR PAINT ROLLER COVERS

This patent application is a continuation-in-part of U.S. patent application Ser. No. 11/740,119, filed on Apr. 25, 2007 now U.S. Pat. No. 7,503,191, entitled "Tubular Sliver Knit Fabric for Paint Roller Covers," and a continuation-in-part of copending U.S. patent application Ser. No. 12/015,612, filed on Jan. 17, 2008, entitled "Method of Manufacturing Paint Roller Covers From a Tubular Fabric Sleeve," and a continuation-in-part of copending U.S. patent application Ser. No. 12/100,050, filed on Apr. 9, 2008, entitled "Method of Manufacturing Paint Roller Covers From a Tubular Fabric Sleeve," all four of which patent applications are assigned to the assignee of the present invention, and all four of which patent applications are hereby incorporated herein by reference in their entirety.

BACKGROUND OF THE INVENTION

Field of the Invention

The present invention relates generally to knit pile fabrics that may be used to produce paint rollers, and more particularly to a tubular knit pile fabric that is manufactured with the pile extending from the outer side thereof and in an extended length, small diameter configuration, the tubular knit pile fabric subsequently being separable into shorter tubular segments that may be secured to paint roller cover cores to produce seamless paint rollers.

The two inventions which have had the greatest impact on paint application are the invention of the paint roller in the 1930's and the development of water-based paint in the late 1940's. While water-based paints are easy to mix, apply, and clean up, there is little doubt that the paint roller has been the greatest single time saving factor in the paint application process, allowing large surfaces to be painted with a uniform coat of paint quickly and easily. Typically, paint rollers are comprised of two components, namely a handle assembly and a paint roller cover for installation onto the handle assembly.

The handle assembly consists of a grip member having a generally L-shaped metal frame extending therefrom, with the free end of the metal frame having a rotatable support for a paint roller cover mounted thereon. The paint roller cover consists of a thin, hollow cylindrical core which fits upon the rotatable support of the handle, with a plush pile fabric being secured to the outer diameter of the paint roller cover. The core may be made of either cardboard or plastic material, with which material is used for the core generally being determined based upon the selling price of the paint roller cover. The pile fabric is traditionally applied as a strip which is helically wound onto the outer surface of the core with adjacent windings of the fabric strip being located close adjacent each other to provide the appearance of a single continuous pile fabric covering on the core.

Typically, the pile fabric is a dense knitted pile fabric, which may be knitted from natural fibers such as wool or mohair, synthetic fibers such as polyester, acrylic, nylon, or rayon, or from a blend of natural and synthetic fibers. The knitting is typically performed on a circular sliver knitting machine, which produces a tubular knitted base material with a knit-in pile in tubular segments which are approximately fifty-eight inches (1473 millimeters) in circumference by thirty to fifty yards (27.43 meters to 45.728 meters) long (depending on fabric weight).

Generally, sliver knitting is a knitting process which locks individual pile fibers directly into a lightweight knit backing or base material in a manner wherein the pile fibers extend from one side of the knit base material. The knit base material itself is made from yarn, which may be knitted in a single jersey circular knitting process on a circular knitting machine, with closely packed U-shaped tufts of the fibers being knitted into the knit base material which anchors them in the completed pile fabric. The free ends of the fibers extend from one side of the knit base material to provide a deep pile face. The knit base material is typically made of synthetic yarns, with the pile being made of a desired natural or synthetic fiber, or a blend of different fibers.

Such fabrics are illustrated, for example, in U.S. Pat. No. 1,791,741, to Moore, U.S. Pat. No. 2,737,702, to Schmidt et al., U.S. Pat. No. 3,226,952, to Cassady, U.S. Pat. No. 3,853,680, to Daniel, U.S. Pat. No. 3,894,409, to Clingan et al., U.S. Pat. No. 4,236,286, to Abler et al., U.S. Pat. No. 4,513,042, to Lumb, and U.S. Pat. No. 6,766,668, to Sinykin, all of which patents are hereby incorporated herein by reference. Sliver knit high pile fabrics have been widely used for many years in the manufacture of imitation fur fabrics, and also have found use, for example, as linings for overcoats and footwear, as coverings for stuffed toys and floors, in applications in pet beds, case liners, boot and slipper liners, medical pads, and blankets, and, of course, as coverings for paint roller covers.

The components of the knitted fabric are a yarn, which is used to knit the fabric's knit base material, and fibers which are supplied in a "sliver" rope, which consists of fibers which are all longitudinally oriented in a rope which is typically less than three inches (76 millimeters) in diameter. The fibers are loose fibers of either a single type or a uniform blend of multiple types of fibers. The fiber mix will determine the performance, density, texture, weight, patterning, and color of the finished pile fabric.

The fibers are typically blown together in an air chamber to blend them, and then are carded in carding machines that "comb" the fibers to align them in parallel with each other. The fibers are then gathered into a soft, thick rope which is called "sliver" (which is the derivation for the term "sliver knit") or "roving." The yarn and the sliver are supplied to the circular knitting machine, which typically has eighteen heads and produces a tubular knit pile fabric which is approximately fifty-eight inches (1473 millimeters) in circumference. (Thus, when the tubular knit pile fabric is slit longitudinally, the fabric is approximately fifty-eight inches (1473 millimeters) wide.)

Such knitting machines are well known in the art, and are illustrated in U.S. Pat. No. 3,894,407, to Clingan et al., U.S. Pat. No. 3,896,637, to Thore, U.S. Pat. Nos. 4,532,780 and 4,592,213, both to Tilson et al., U.S. Pat. Nos. 5,431,029, 5,546,768, 5,577,402, 5,685,176, and 6,016,670, all to Kukrau et al., and U.S. Pat. No. 6,151,920, to Schindler et al., all of which patents are hereby incorporated herein by reference. Examples of commercial versions of such knitting machines are the Model SK-18 II Sliver Knitter and the Model SK-18J II Sliver Knitter which are available from Mayer Industries, Inc. of Orangeburg, S.C.

The first commercial circular sliver knitting machine had seven heads, and commercially-available circular knitting machines today have between seven and eighteen heads. Eighteen head knitting machines have upwards of one thousand needles, and produce tubular knitted segments that are approximately nineteen inches (483 millimeters) in diameter (fifty-eight inches (1473 millimeters) in circumference). All of these circular sliver knitting machines produce tubular knitted pile fabric segments having the pile located on the inside. Such circular sliver knitting machines are incapable of either producing tubular knitted pile fabric segments having the pile on the outside or small diameter tubular knitted pile fabric segments.

Following the manufacture of the tubular knitted pile segments on a circular sliver knitting machine, the tubular knitted pile segments are slit longitudinally to produce extended knitted pile segments of fabric which are typically fifty-eight inches (1473 millimeters) wide by thirty to fifty yards (27.43 meters to 45.728 meters) long. These extended knitted pile segments of fabric are then tensioned longitudinally and transversely, stretched to a sixty inch (1524 millimeter) width or greater to guarantee the proper number of two and seven-eighth inch (73 millimeter) strips, and back coated (on the non-pile side of the knit base material) with a stabilized coating composition such as a clear acrylic polymer. The coating composition which is coated onto the non-pile side of the knit base material is then processed, typically by heat, to stabilize the coated, extended knitted pile segment. The heating operation dries and bonds the coating composition to the knit base material, producing a fabric which is essentially lint-free.

The coated, extended knitted pile segment can then be subjected to a shearing operation to achieve a uniform pile length, with the sheared fibers being removed by vacuum, electrostatically, or by any other known removal technique. The pile density, the nap length, and the stiffness of the fibers are varied based upon custom specifications and the particular characteristics of the paint roller cover that are desired.

The sheared, coated, extended knitted pile segment is then slit into a plurality of two and seven-eighths inch (73 millimeter) wide knitted pile fabric strips, of which there are typically twenty for a sixty inch (1524 millimeter) wide fabric segment. Following this slitting operation, the strips must be vacuumed to remove stray fibers and lint. The knitted pile fabric strips are rolled onto a core to produce twenty rolls of knitted pile fabric strips, each of which is thirty to fifty yards long. These rolls of knitted pile fabric strips may then be shipped to a paint roller cover manufacturer. Alternately, a plurality of standard lengths of the fabric may be seamed together to produce an extended length fabric strip which may be helically wound in consecutive rows upon a core as taught in U.S. Pat. No. 6,502,779, U.S. Pat. No. 6,685,121, U.S. Pat. No. 6,902,131, U.S. Pat. No. 6,918,552, and U.S. Pat. No. 6,929,203, all to Jelinek et al., all of which patents are hereby incorporated herein by reference.

Both the standard length rolls of knitted pile fabric strips and the rolls of extended length knitted pile fabric strips have substantial material costs and labor costs that are incurred in the manufacturing process after the circular knitting process. The material costs include the cost of the coating material, losses due to fly (fly are extra fibers that come loose from the knitted pile fabric), losses during the cutting of the sixty inch (1524 millimeter) wide fabric segment into twenty knitted pile fabric strips, and seam losses throughout the operation. The labor costs include the costs to perform the coating process, the brushing, the second pass shearing, and all of the finishing steps within the traditional sliver knit operation including slitting and continuously coiling the fabric slits.

Paint roller covers are manufactured by using a hollow cylindrical core made of cardboard or thermoplastic material which has the knitted pile fabric strip helically wound around the core. During the manufacture of paint roller covers, the knitted pile fabric strips are secured to the core either by using adhesive or epoxy, or by thermally bonding the knitted pile fabric strip in place on a thermoplastic core. For examples of these manufacturing processes see U.S. Pat. No. 4,692,975, to Garcia (the "'975 patent"), U.S. Pat. No. 5,572,790, to Sekar (the "'790 patent"), and U.S. Pat. No. 6,159,320, to Tams et al. (the "'320 patent"), each of which are hereby incorporated by reference.

The '975 patent uses a core that is cut from preformed thermoplastic (e.g., polypropylene) tubular stock. The core is mounted on a rotating spindle, and a movable carriage mounted at an angle to the spindle feeds a continuous strip of knitted pile fabric onto the core, with the carriage moving parallel to the spindle in timed relation to its rotation so that the knitted pile fabric strip is wound on the plastic core in a tight helix. Also mounted to the movable carriage is a heat source for heat softening the thermoplastic core just in advance of the point where the knitted pile fabric strip is applied to the thermoplastic core, such that the knitted pile fabric is heat bonded to the thermoplastic core as it is wound thereupon. The bond formed between the knitted pile fabric and the thermoplastic core is a strong one not subject to separation from exposure to paint solvents.

The '790 patent uses a core that is formed from a strip (or multiple strips) of thermoplastic material that is (are) helically wound about a stationary mandrel. Alternately, the core may be formed by applying liquefied thermoplastic material to a drive belt which transfers the thermoplastic material to the mandrel. A layer of adhesive is then applied to the outer surface of the core, and the knitted pile fabric strip is applied to the core by helically winding the knitted pile fabric strip onto the core. Alternately, the paint roller cover may instead be made by bonding, in a single step, a knitted pile fabric strip to a wound strip of thermoplastic material that is wrapped about the mandrel.

The '320 patent extrudes a cylindrical plastic core through a rotating extruder head that is cooled, with the outer surface of the core then being plasma treated. The knitted pile fabric strip is secured onto the plasma treated outer surface of the core by extruding thin films of first and second epoxy resin subcomponents onto the outer surface of the core as it is extruded, cooled, and plasma treated in a continuous process.

Other variations are also known, particularly in technologies relating to manufacturing pile fabric suitable for use on paint roller covers. For example, instead of using knitted pile fabric, woven pile fabric can be substituted. Woven pile fabric consists of three yarns—a knit base material or warp yarn, a filling or weft yarn, and a pile yarn. The threads of warp yarn are held taut and in a parallel array on a loom, and the threads of weft yarn are woven across the threads of warp yarn in an over/under sequence orthogonal to the threads of warp yarn, with threads of pile yarn being woven into the weave of warp and weft yarns such that the threads of pile yarn extend essentially perpendicularly from one side of the fabric. Such woven pile fabric may be processed in a manner similar to that described above with regard to the processing of knitted pile segments of fabric to produce strips of woven pile fabric that can be helically wound onto paint roller cover cores.

However, all paint roller covers manufactured using the methods described above have a seam. As the strips of fabric are helically wound around the cores, the fabric strips wrap contiguously around the core, thereby creating a helical seam that is located throughout the cover. The seam inevitably produces a less than optimal paint roller cover since a seam can interfere with the uniform application of paint from the paint roller cover. The helical winding process of manufacturing a paint roller cover requires careful attention to contiguous winding. Errors resulting in overlapped fabric or gaps in the contiguous winding process often occur, resulting in increased scrap or marketing poor quality covers. Such seams have the potential, particularly with short nap paint roller covers, to produce a seam mark or stippling effect on the surface being painted, particularly if the paint being applied combines with the seams to produce a more pronounced defective characteristic in the surface being painted.

An examination of prior technology in the paint roller cover arts reveals that this problem has been recognized in the past, with several solutions that have been proposed to deal with the challenge presented by the presence of seams in paint roller covers. The first of these, U.S. Pat. No. 2,600,955, to Barnes et al., which patent is hereby incorporated herein by reference, discloses a paint roller cover made from a segment of canvas tubing that has yarn loops sewn therethrough, with the ends of the loops on the outside of the segment of the canvas tubing being cut. This approach is certainly far too expensive to represent a viable solution, and would not compare well to currently commercially available paint roller covers in the quality of the paint coat that could be applied.

Another approach is shown in U.S. Pat. No. 2,704,877 and U.S. Pat. No. 2,752,953, both to Arnold Schmidt, which patents are hereby incorporated herein by reference, which patents are related and disclose a tubular knitted pile fabric that is stated to have been manufactured on an apparatus disclosed in U.S. Pat. No. 1,849,466, to Moore, which patent is hereby incorporated herein by reference. The apparatus disclosed in Moore, which is hand operated, was stated in several related patents to Sannipoli et al. (U.S. Pat. No. 2,920,372, U.S. Pat. No. 2,944,588, and U.S. Pat. No. 3,010,867, which patents are hereby incorporated herein by reference) to be capable of manufacturing a seamless tubular knitted sleeve in which the pile is located on the interior of the sleeve, thereby requiring that the sleeve be inverted prior to mounting it on a core to form a paint roller cover. As such, the apparatus disclosed in Moore is incapable of manufacturing a knitted sleeve in which the pile is located on the exterior of the sleeve.

The Sannipoli et al. patents inverted the tubular knitted sleeve by positioning it within a hollow tube and pulling one end of the tubular knitted sleeve around the end of the tube and pushing successive portions of the tubular knitted sleeve along the outside of the tube. The Arnold Schmidt '877 patent (which failed to disclose how it inverted the knitted sleeve with the pile on the interior thereof) disclosed a machine for treating and shearing inverted tubular knitted sleeves, and the Arnold Schmidt '953 patent disclosed using the inverted, treated, and sheared tubular knitted sleeves by stretching them and pulling them over a tube or shell to form a paint roller.

The problem that has prevented the inventions of the Arnold Schmidt patents and the Sannipoli et al. patents from being either practical or commercially successful is that the process of inverting a tubular knitted sleeve having the pile on the interior of the sleeve inevitably damages the fabric of the tubular knitted sleeve. When the fabric is inverted, the material of the fabric is deformed due to stretching that occurs during the process of inverting the tubular knitted sleeve. This deformation tends to increase the diameter of the tubular knitted sleeve, thus requiring it to be stretched lengthwise to restore it to its former diameter. Not only is this process difficult and expensive, but it also results in variable density of the fabric as well as introducing the prospect of adhesive or thermoplastic bleed-through within the stitches. Such problems will result in unacceptable product quality in paint roller covers made from this type of fabric.

It has been determined that the inverting approach taught by the Sannipoli et al. patents and useable by the Arnold Schmidt patents has three drawbacks that make it impracticable. The first drawback of the inverting method is that it requires a high degree of manual operation in that it requires cutting of the tubular knitted sleeves to size and placement of the tubular knitted sleeves into the tubes of the inverting machine. The second drawback of the Sannipoli et al. method is that only relatively short length tubular knitted sleeves representing a single paint roller cover (typically nine inches (229 millimeters)) can be processed at a time, which makes the method inherently unsuitable for mass production.

The third, and by far the most serious, drawback of the Sannipoli et al. method is that the process of inverting the tubular knitted sleeves inevitably results in stretching the tubular knitted sleeves so that they will not snugly fit on the paint roller cover cores, potentially creating creases in a high percentage of them when they are adhesively secured to the paint roller cover cores. This results in an unacceptably high percentage of them being defective and necessitating them being scrapped, resulting in an unacceptably high scrap cost. Predictably, the inventions taught in the Sannipoli et al. patents and the Arnold Schmidt patents have never found commercial acceptance due to these serious disadvantages.

The above-incorporated by reference U.S. patent application Ser. No. 11/740,119 discloses a tubular sliver knitted pile fabric which is manufactured with the sliver pile side facing outwardly rather than inwardly and with a diameter suitable for mounting on a paint roller cover core in a seamless manner. While the tubular knitted pile fabric in this patent application is disclosed as being for installation onto a core member, the method used to install the tubular knitted pile fabric onto the outer surface of the core member is not disclosed.

While this tubular sliver knitted pile fabric has been found to be quite satisfactory, it is desirable to provide an alternative tubular pile fabric which has a cut pile made of yarn rather than sliver fibers. A conventional circular knitting machine for the production of cut pile fabric is shown, for example, in U.S. Pat. No. 4,592,212, to Walter Schmidt, which patent is hereby incorporated herein by reference. The Walter Schmidt patent produces a conventional large diameter tubular fabric having the cut pile located on the inside of the tubular fabric, and as such does not produce a tubular fabric which is useful for the manufacture of a paint roller cover, other than by cutting it into strips and using the helical winding assembly technique discussed above. It is accordingly the primary objective of the present invention that it provide a tubular cut pile knit paint roller cover fabric suitable for use in the manufacture of a paint roller cover. It is a related principal objective of the present invention that the cut pile knit paint roller cover fabric be manufactured with the pile side facing outwardly rather than inwardly, thereby obviating the need to invert it prior to mounting it on a paint roller cover core. It is an additional related principal objective of the present invention that the cut pile knit paint roller cover fabric be of a size suitable for mounting on a paint roller cover core in a seamless manner, without cutting except to a length fitting the length of paint roller cover core material on which the cut pile knit paint roller cover fabric is to be mounted.

It is also an objective of the present invention that the cut pile knit paint roller cover fabric be suitable for use in its application on a paint roller cover without experiencing any significant degradation of the cut pile knit paint roller cover fabric due to its contact with a wide variety of paints, enamels, stains, etc. It is a further objective of the present invention that the cut pile knit paint roller cover fabric be manufactured in a manner in which the pile loops are securely retained by the knit base material such that the shedding of pile fibers from the cut pile knit paint roller cover fabric is minimized. It is a still further objective of the present invention that the cut pile knit paint roller cover fabric be manufacturable in extended length segments that may later be cut to tubular segments of any desired length.

The cut pile knit paint roller cover fabric of the present invention must also be of construction which is both durable and long lasting when it has been secured to a paint roller cover core, and the resulting paint roller cover should provide the user with an acceptably long lifetime. In order to enhance the market appeal of the cut pile knit paint roller cover fabric of the present invention, it should also be inexpensive to manufacture to thereby afford it the broadest possible market. Finally, it is also an objective that all of the aforesaid advantages and objectives of the cut pile knit paint roller cover fabric of the present invention be achieved without incurring any substantial relative disadvantage.

SUMMARY OF THE INVENTION

The disadvantages and limitations of the background art discussed above are overcome by the present invention. With this invention, a cut pile knit fabric is provided that has several key characteristics that radically differentiate it from prior cut pile knit fabrics. The first and most important of these differentiating factors is that the cut pile knit paint roller cover fabric of the present invention is manufactured in a tubular segment with the pile located on the outside of the tubular cut pile knit paint roller cover fabric rather than on the inside, in this manner obviating the need to invert the tubular cut pile knit paint roller cover fabric and thereby deform the tubular cut pile knit paint roller cover fabric. The second key differentiating factor is that the tubular cut pile knit paint roller cover fabric of the present invention is manufactured in a size that makes it appropriate for installation onto paint roller cover cores, which typically have an inner diameter of approximately one and one-half inches (38 millimeters) and an outer diameter of approximately one and five-eighths inches (41 millimeters) to one and three-quarters inches (44 millimeters).

The tubular cut pile knit paint roller cover fabric of the present invention has a knitted base material that is knit in a single jersey circular knitting process on a radically redesigned circular knitting machine that is designed to produce the tubular cut pile knit paint roller cover fabric of the present invention. The jersey knitted knit base material of the tubular cut pile knit paint roller cover fabric of the present invention has a plurality of courses (which are rows of loops of stitches which run across the tubular cut pile knit paint roller cover fabric (around the circumference of the tubular cut pile knit paint roller cover fabric)) and a plurality of wales (which are vertical chains of loops in the longitudinal direction of the tubular cut pile knit paint roller cover fabric). The number of wales together with the gauge (the number of courses per circumferential inch) determines the diameter of the tubular cut pile knit paint roller cover fabric of the present invention. In the tubular cut pile knit paint roller cover fabric of the present invention, the number of wales can vary between approximately forty and one hundred wales, with the currently preferred embodiment having approximately fifty-six wales.

The knitting of the stitches of the knit base material is used to anchor loops of pile yarn which are cut, with the free ends of the pile loops extending from the outer side of the knit base material of the tubular cut pile knit paint roller cover fabric of the present invention. As the tubular cut pile knit paint roller cover fabric of the present invention is knit, the height of the outermost ends of the cut pile loops may be varied to product longer or shorter pile, and will typically vary between approximately one-quarter inch (6.35 millimeters) and three inches (76 millimeters).

The tubular cut pile knit paint roller cover fabric of the present invention may be manufactured in extended lengths, which may be cut to the desired lengths subsequent to its manufacture. Notably, the tubular cut pile knit paint roller cover fabric of the present invention does not require inverting since the pile is located on the outside. It will be appreciated by those skilled in the art that the tubular cut pile knit paint roller cover fabric of the present invention does not require slitting since it is produced to fit over paint roller cover cores rather than to be wound helically around paint roller cover cores. Thus, all of the post-knitting material and labor costs mentioned above with reference to the manufacture of standard or extended length rolls of knitted pile fabric strips are not incurred in the manufacturing of the tubular cut pile knit paint roller cover fabric of the present invention.

The tubular cut pile knit paint roller cover fabric of the present invention may be cut to single paint roller length (typically nine inches (229 millimeters)), or it may be cut to fit a longer length paint roller cover core segment, such as, for example, sixty-four inches (1625 millimeters). Following application of the longer length paint roller cover core segment to the longer length paint roller cover core segment, it may be cut into smaller paint roller covers, such as, for example, seven nine inch (229 millimeter) paint roller covers. Alternately, the extended paint roller cover segments may be manufactured at the same facility manufacturing the tubular cut pile knit paint roller fabric, with the extended paint roller cover segments being shipped to a paint roller manufacturer for finishing.

Finishing either the cut-to-length paint roller covers or the extended paint roller cover segment may include combing the cut pile knit paint fabric on the paint roller cover and shearing the cut pile knit paint fabric on the paint roller cover. These finishing steps may occur either before or after cutting the paint roller covers to the desired length. Finally, the edges of the paint roller covers are beveled, and any loose pile fibers may be vacuumed off. The finishing of extended paint roller cover segments may be performed using the MBK Maschinenbau GmbH paint roller finishing machine distributed by Roller Fabrics, an Edward Jackson (Engineer) Limited finishing machine, or other equipment custom built by individual paint roller manufacturers.

The tubular cut pile knit paint roller cover fabric of the present invention may be mounted onto a paint roller cover core in any desired manner. Different ways of adhering the tubular cut pile knit paint roller cover onto a paint roller cover core may be used as desired. The tubular cut pile knit paint roller cover fabric of the present invention is suitable for paint roller cover cores made according to any of a variety of ways.

It may therefore be seen that the present invention provides a tubular cut pile knit paint roller cover fabric that is suitable for use in the manufacture of a paint roller cover. The tubular cut pile knit paint roller cover fabric of the present invention is manufactured with the pile side facing outwardly rather than inwardly, thereby obviating the need to invert it prior to mounting it on a paint roller cover core. The tubular cut pile knit paint roller cover fabric of the present invention is of a size suitable for mounting on a paint roller cover core in a seamless manner, without cutting it except for cutting it to a length fitting the length of paint roller cover core material on which the tubular cut pile knit paint roller cover fabric is to be mounted.

The tubular cut pile knit paint roller cover fabric of the present invention is well suitable for use in its application on a paint roller cover, and will not experience any significant degradation of the tubular cut pile knit paint roller cover fabric due to its contact with a wide variety of paints, enamels, stains, etc. The tubular cut pile knit paint roller cover fabric of the present invention is manufactured in a manner in which the pile loops are securely retained by the knit base material such that the shedding of pile fibers from the tubular cut pile knit paint roller cover fabric is minimized. The tubular cut pile knit paint roller cover fabric of the present invention is also manufacturable in extended length segments that may later be cut to tubular segments of any desired length.

The tubular cut pile knit paint roller cover fabric of the present invention is of a construction which is both durable and long lasting when it has been secured to a paint roller cover core, and the resulting paint roller cover will provide the user with an acceptably long lifetime. The tubular cut pile knit paint roller cover fabric of the present invention is also inexpensive to manufacture, thereby enhancing its market appeal and to affording it the broadest possible market. Finally, all of the aforesaid advantages and objectives of the tubular cut pile knit paint roller cover fabric of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
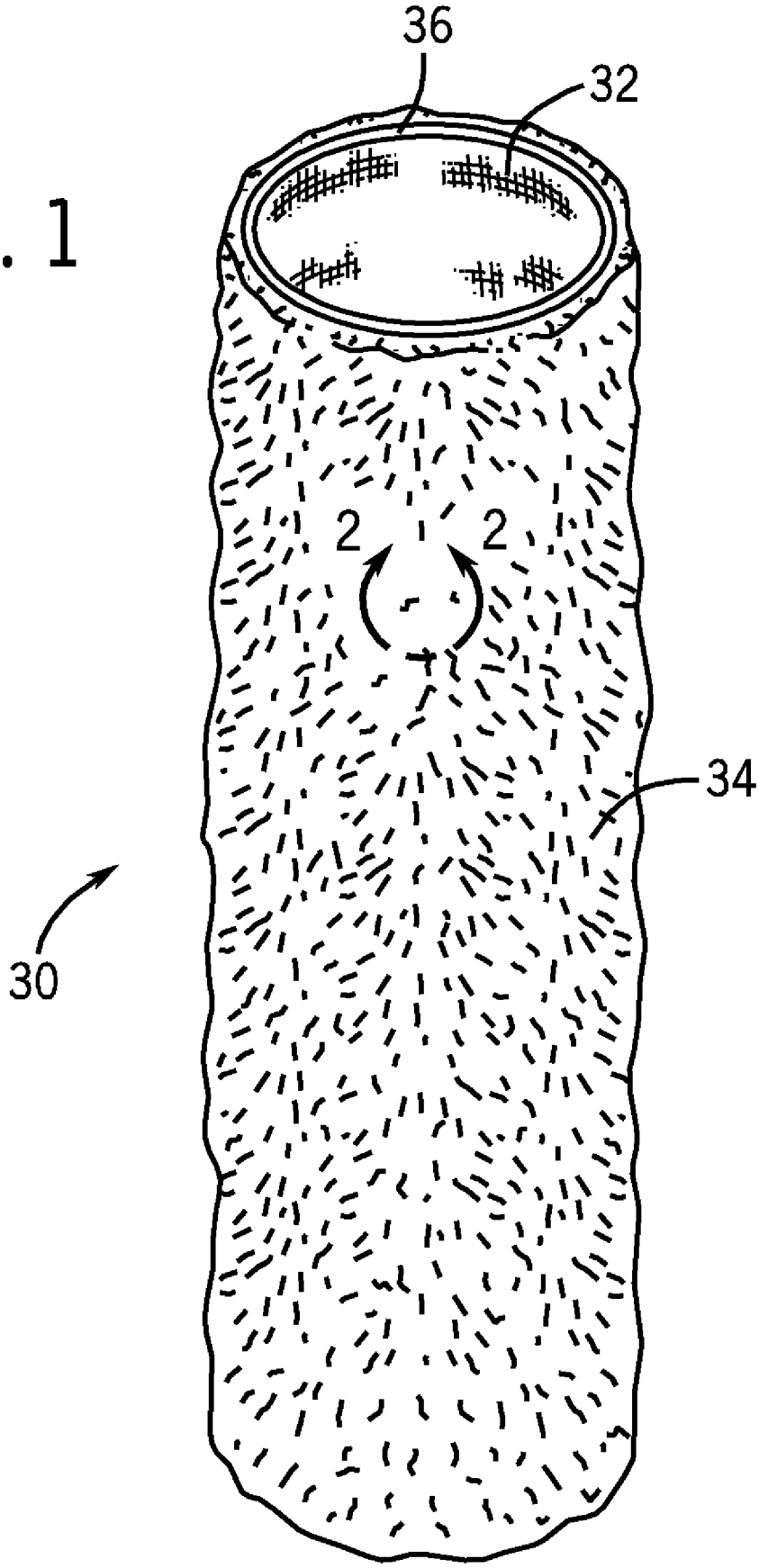
FIG. 1 is an isometric view of a segment of tubular cut pile knit paint roller fabric made according to the teachings of the present invention with the cut pile extending outwardly, showing a tubular knit base having cut pile segments extending outwardly therefrom.

The preferred embodiment of the cut pile knit paint roller cover fabric of the present invention produces a tubular cut pile knit segment 30 as shown in FIG. 1 that may be continuously knitted in an extended length. The tubular cut pile knit segment 30 consists of a lightweight knit backing or base material 32 having cut pile segments 34 extending from the knit base material 32 on the outer surface of the tubular cut pile knit segment 30. It may be seen from a top edge 36 of the knit base material 32 that the tubular cut pile knit segment 30 has an essentially circular cross section. The tubular cut pile knit segment 30 may be knitted in as long a length as desired, notwithstanding that FIG. 1 only shows a relatively short segment of the tubular cut pile knit segment 30.

Figure 2:
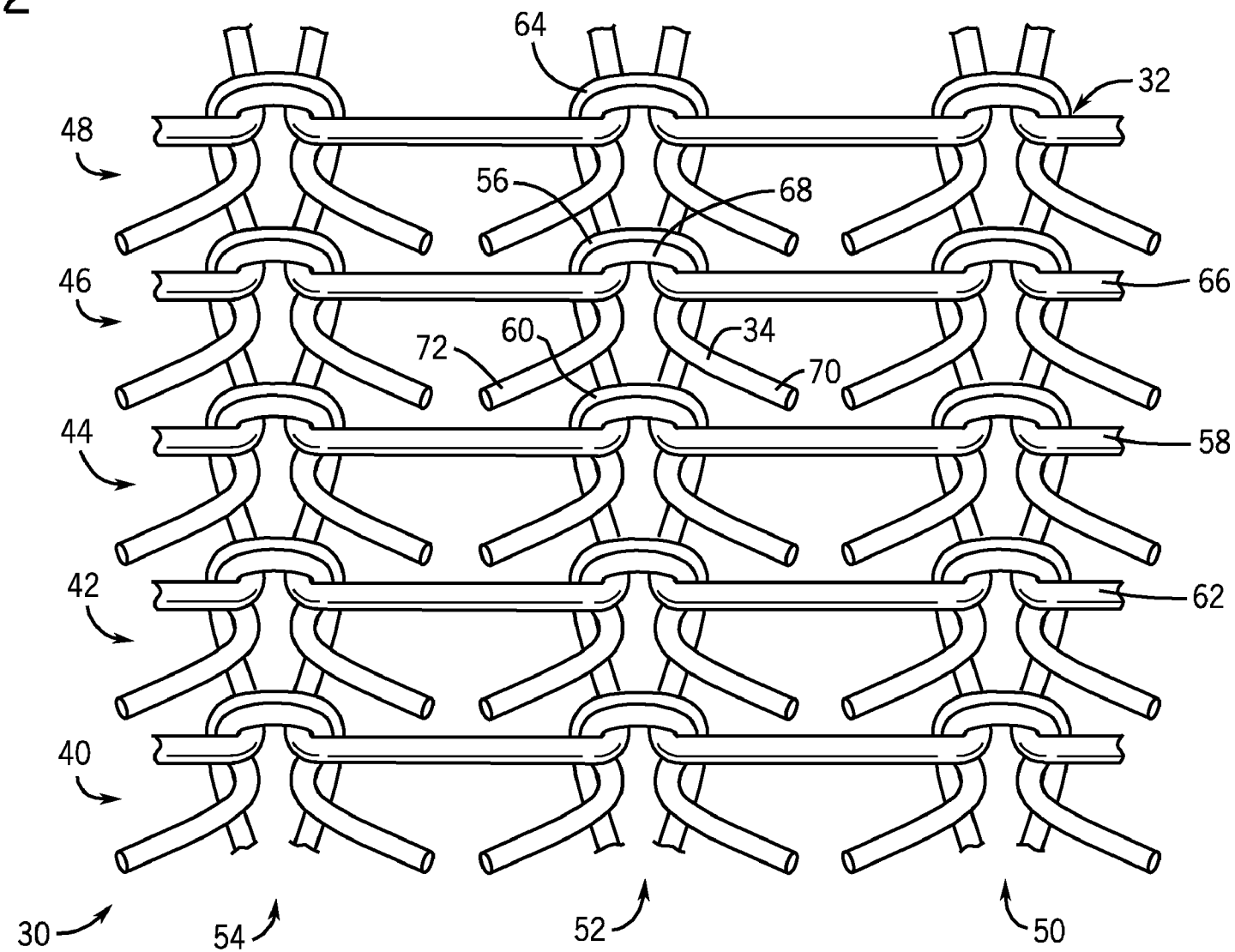
FIG. 2 is a schematic view of a portion of the tubular paint roller fabric illustrated in FIG. 1 from the outside, showing the knitting pattern of the base yarn and the placement of cut pile segments into the knit base.

Referring next to FIG. 2, a segment of the tubular cut pile knit segment 30 is shown in schematic form from the outside thereof to illustrate the knit of the knit base material 32, and the manner in which the cut pile segments 34 are knitted into the knit base material 32. Those skilled in the art will at once realize that while the cut pile segments 34 shown in FIG. 2 include only a few cut pile ends for added clarity and understanding of the construction of the tubular cut pile knit segment 30, there are sufficient cut pile segments 34 in the tubular cut pile knit segment 30 to make a pile that is sufficiently dense for the intended use of the tubular cut pile knit segment 30 in the manufacture of a paint roller cover.

The foundation of the tubular cut pile knit segment 30 is the knit base material 32, which may be knit in a highly modified single jersey circular knitting process on a radically redesigned circular knitting machine. The knit base material 32 has a plurality of courses (which are rows of loops of stitches which run across the knit fabric), five of which are shown and designated by the reference numerals 40, 42, 44, 46, and 48, and a plurality of wales (which are vertical chains of loops in the longitudinal direction of the knit fabric), three of which are shown and designated by the reference numerals 50, 52, and 54. The respective courses 40, 42, 44, 46, and 48 are knitted sequentially from the lowest course number to the highest course number.

By way of example, the construction of the portion of the tubular cut pile knit segment 30 in the area of the course 46 and the wale 52 will be discussed herein. A backing loop 56 formed in a backing yarn segment 58 is located in this area, with a backing loop 60 formed in a backing yarn segment 62 being located in the course 44 below the backing loop 56, and a backing loop 64 formed in a backing yarn segment 66 being located in the course 48 above the backing loop 56. The backing loop 56 extends through the backing loop 60 from the outside to the inside of the tubular cut pile knit segment 30 (shown in FIG. 2), and the backing loop 64 also extends through the backing loop 56 from the outside to the inside. It will at once be appreciated by those skilled in the art that this arrangement of backing loops in sequentially knitted courses is completely opposite to the way in which knit fabrics have been knitted on known circular knitting machines.

A cut pile segment 34 having a pile loop portion 68 and opposite pile ends 70 and 72 is knitted into the knit base material 32 together with the backing loop 56. The pile loop portion 68 of that particular cut pile segment 34 is located adjacent the top of the backing loop 56, and the opposite pile ends 70 and 72 of that particular cut pile segment 34 extend outwardly from the interior of the backing loop 56, above the backing loop 60 and below the backing loop 64. In a similar manner, each of the other cut pile segments 34 is knitted into the knit base material 32 with a different backing loop.

FIGS. 3 through 15 illustrate a cut pile knitting process which may be used to knit the tubular cut pile knit segment 30 shown in FIGS. 1 and 2. These figures show in sequential fashion how a stitch is formed. Each of these figures shows a dial needle 80 having a hook 82 located at the distal end thereof and a latch 84 that has a proximal end that is pivotally mounted at a location on the dial needle 80 that is proximal of the hook 82. The latch 84 can pivot between a closed position (shown in FIGS. 3, 7, 12, 13, 14, and 15) in which the distal end of the latch 84 contacts the end of the hook 82 to form an enclosed area with the hook 82, and an opened position (shown in FIGS. 5, 9, and 10) in which the distal end of the latch 84 forms a small acute angle with the proximal end of the dial needle 80. FIGS. 4, 6, 8, and 11 show the latch 84 in intermediate positions.

Each of FIGS. 3 through 15 also shows two cylinder needles 86 that are respectively located below and on opposite sides of the distal end of the dial needle 80. The cylinder needles 86 each have a hook 88 located at the distal end thereof, and a tapered cutting edge 90 located a short distance from the hook 88. The tapered cutting edge 90 is coplanar with the hook 88, and extends outwardly progressively further as it extends further from the hook 88. The dial needle 80 and the cylinder needles 86 are oriented essentially orthogonally to each other.

FIGS. 3 through 15 show the tubular cut pile knit segment 30 in phantom lines, with only several backing loops in a single wale being shown in solid lines. Specifically, sequential backing loops 92, 94, and 96 are shown in each of FIGS. 3 through 15, with the backing loops 92, 94, and 96 being in courses that are knitted sequentially from the course containing the lowest backing loop number to the course containing the highest backing loop number. It may be seen that the wales and courses containing the backing loops 92 and 94 already have cut pile loops 98 knitted therein. The knitting process shown in FIGS. 3 through 15 shows the knitting of a new pile loop 102 into the wale and course containing the backing loop 96 as well as the knitting of a new backing loop 106 in a new course being knit above (and thereby in the same wale as) the backing loop 96.

Note that in each of FIGS. 3 through 15, the dial needle 80 is generally located inside the tubular cut pile knit segment 30 with its distal end (the end with the hook 82) extending from the interior of the tubular cut pile knit segment 30 radially outwardly. Thus, movement of the dial needle 80 in a proximal direction is defined as movement radially inwardly with respect to the tubular cut pile knit segment 30, and movement of the dial needle 80 in a distal direction is defined as movement radially outwardly with respect to the tubular cut pile knit segment 30. The dial needle 80 is oriented such that the latch 84 pivots upwardly and the opening defined by the hook 82 is located above the tubular cut pile knit segment 30, and the movement of the dial needle 80 is radial with respect to the tubular cut pile knit segment 30. Those skilled in the art will at once appreciate that the location, orientation, and movement of the dial needle 80 is radically different from the location, orientation, and movement of needles in currently known circular pile knitting machines. (The needles in currently known circular pile knitting machines are oriented essentially parallel to the axis of the tubular segment being knit, with the hooks of the needles located above the top end of the tubular segment being knit.)

Note also that in each of FIGS. 3 through 15, the cylinder needles 86 are located outside the tubular cut pile knit segment 30 and are oriented in essentially parallel fashion to the longitudinal axis of the tubular cut pile knit segment 30 with their distal ends (the ends with the hooks 88) extending upwardly at locations near the top edge 36 of the tubular cut pile knit segment 30. Thus, movement of the cylinder needles 86 in a proximal direction is defined as movement upwardly with respect to the top edge 36 of the tubular cut pile knit segment 30, and movement of the cylinder needles 86 in a distal direction is defined as movement downwardly with respect to the top edge 36 of the tubular cut pile knit segment 30. The cylinder needles 86 are oriented such that the tapered cutting edge 90 and the opening defined by the hook 88 are located away from the tubular cut pile knit segment 30, and the movement of the cylinder needles 86 is up and down parallel to the longitudinal axis of the tubular cut pile knit segment 30. Those skilled in the art will at once appreciate that the location, orientation, and movement of the cylinder needles 86 is radically different from the location, orientation, and movement of needles in currently known circular pile knitting machines.

The knitting process that is schematically illustrated in FIGS. 3 through 15 may be thought of as comprising three stages. In the first stage of the knitting process, shown in FIGS. 3 through 7, a new pile loop is knitted into the tubular cut pile knit segment 30. During this first stage, both the dial needle 80 and cylinder needles 86 are utilized to creating the new pile loop from pile yarn. In the second stage of the knitting process, shown in FIGS. 8 through 13, a new backing loop is knitted into the tubular cut pile knit segment 30. During this second stage, only the dial needle 80 is utilized to create the new backing loop from backing yarn, with the cylinder needles 86 remaining stationary. In the third stage of the knitting process, shown in FIGS. 14 and 15, the new pile loop is cut to form a cut pile loop. During this third stage, only the cylinder needles 86 are utilized to cut the new pile loop free from the pile yarn, with the dial needle 80 remaining stationary.

Figure 3:
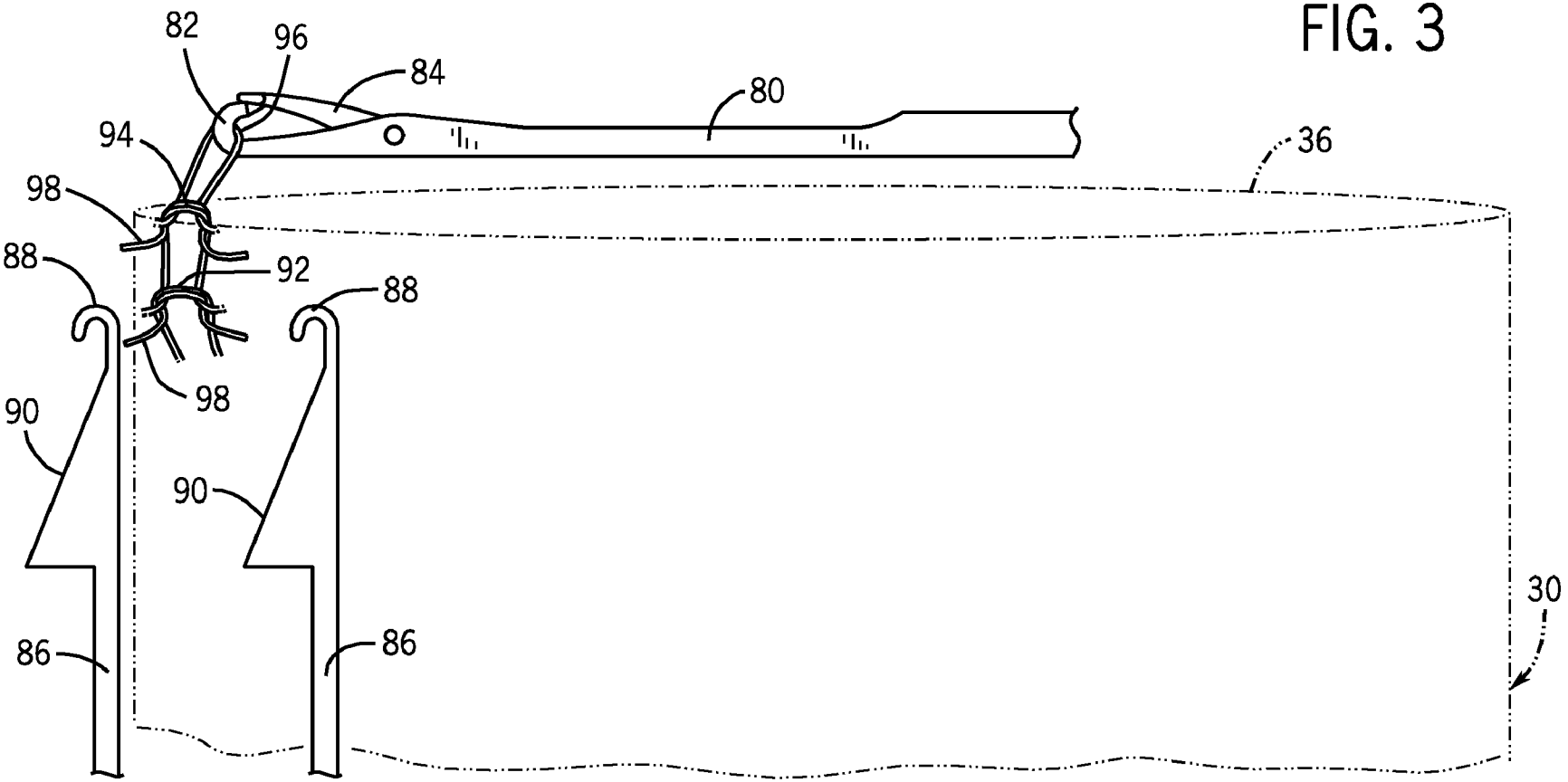
FIG. 3 is a schematic view of a knitting dial needle having a hook located at the distal end thereof and a latch pivotally mounted at a position proximal from the hook, also showing two knitting cylinder needles located on opposite sides of the dial needle, the dial needle and the cylinder needles being used to knit a tubular paint roller fabric similar to the one illustrated in FIGS. 1 and 2, with the dial needle being in a resting position with regard to an old backing loop on the dial needle and the cylinder needles being in their fully downward position.

As mentioned above, the first stage of the knitting process is shown in FIGS. 3 through 7. Referring first to FIG. 3, the dial needle 80 is shown in its fully proximal or resting position, with the backing loop 96 engaged by the hook 82 of the dial needle 80 (near the distal-most end of the dial needle 90) and with the latch 84 in its closed position with the distal end of the latch 84 adjacent the distal end of the hook 82. The cylinder needles 86 are each shown in their fully proximal or resting position.

Figure 4:
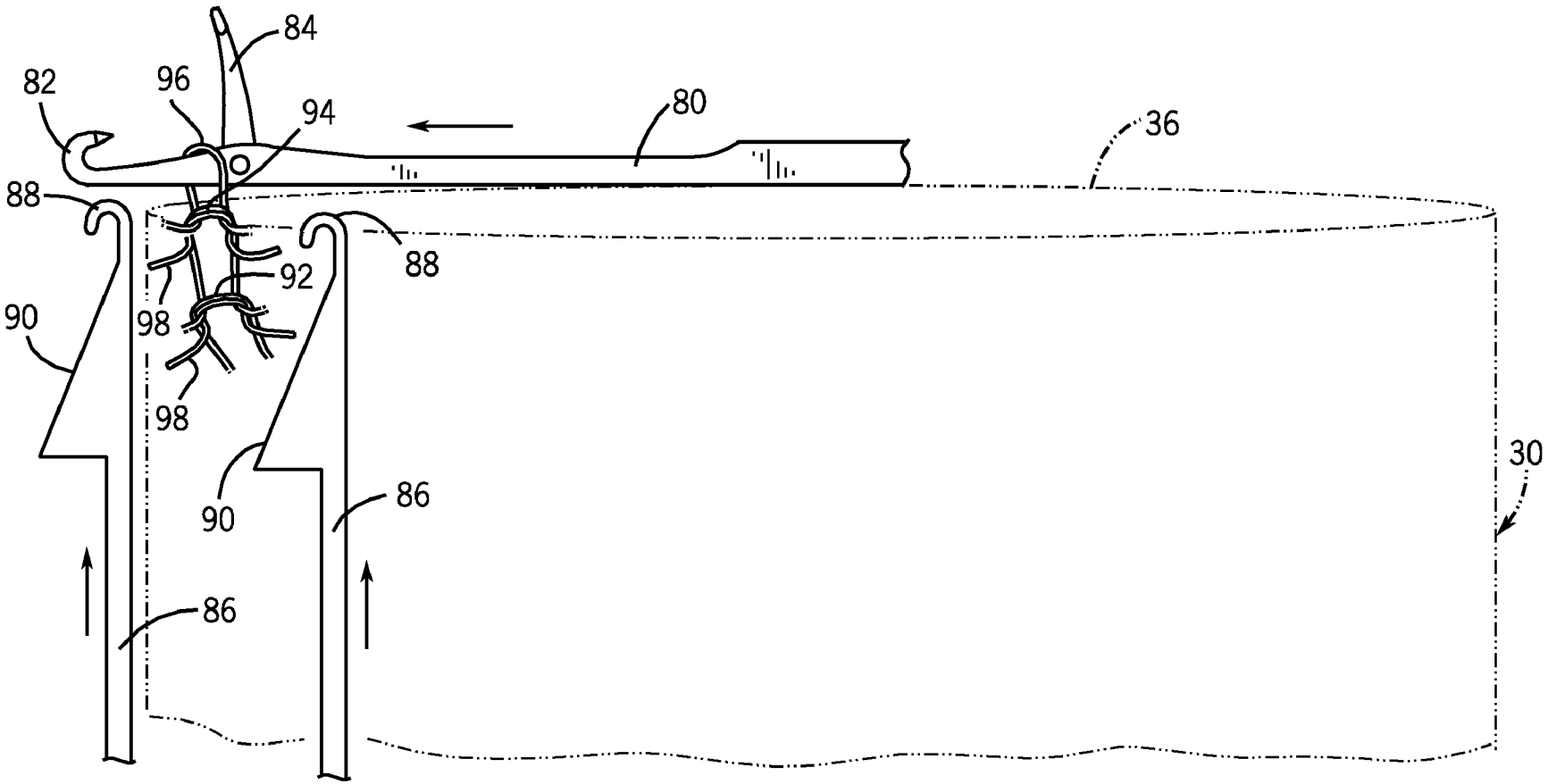
FIG. 4 is a schematic view of the dial needle and the cylinder needles and the tubular paint roller fabric shown in FIG. 3, with the dial needle moving in a distal direction and the old backing loop beginning to open the latch of the dial needle, and the cylinder needles moving in an upward direction.

Referring next to FIG. 4 in contrast with FIG. 3, it may be seen that the dial needle 80 has moved in a distal direction, and the backing loop 96 has begun to open the latch 84, causing the latch 84 to move to a position approximately midway between its closed and opened positions. Note that the backing loop 96 is adjacent the proximal end of the latch 84. Simultaneously, the cylinder needles 86 have also begun to move in a distal (upward) direction.

Figure 5:
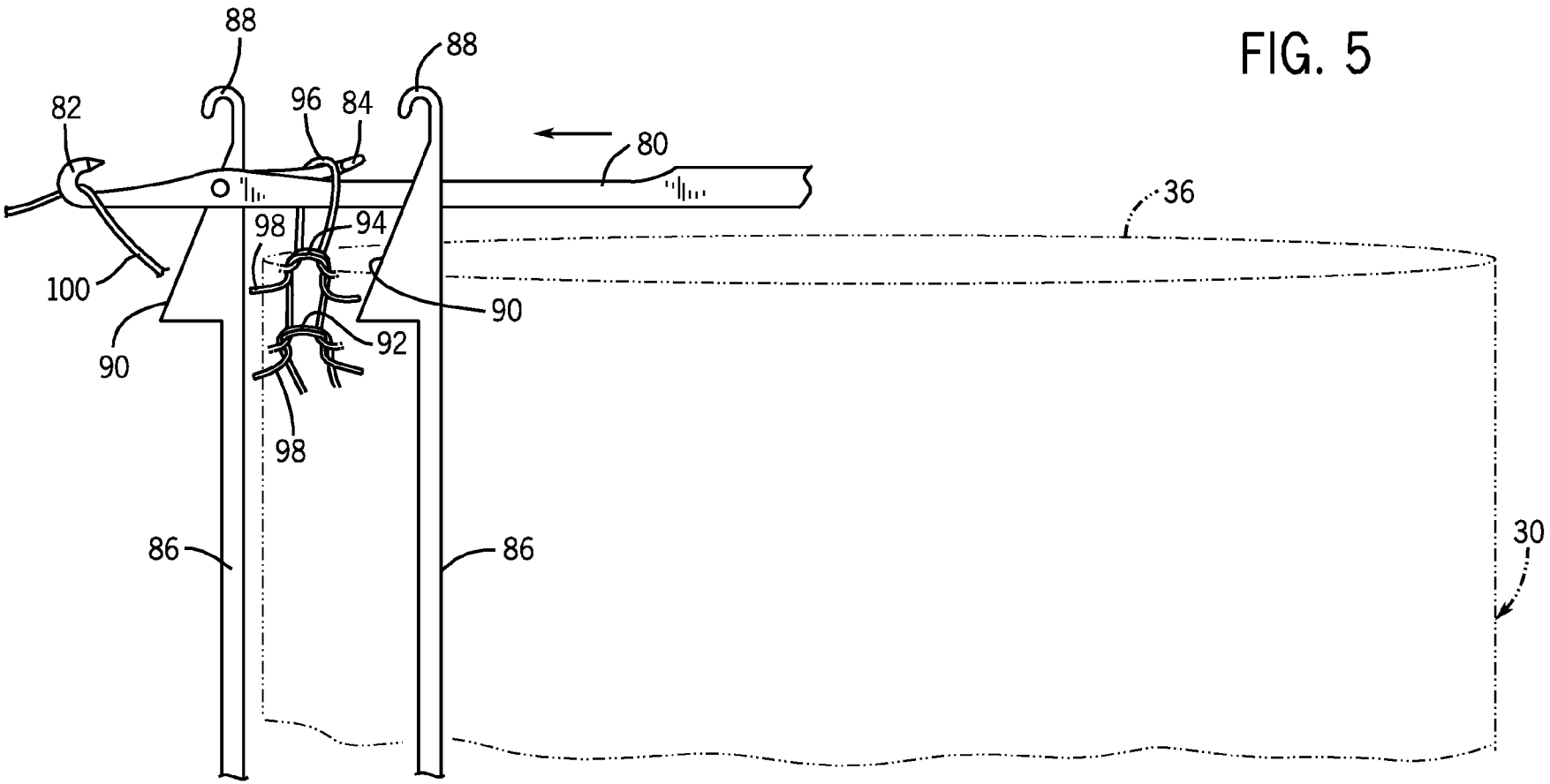
FIG. 5 is a schematic view of the dial needle and the cylinder needles and the tubular paint roller fabric shown in FIGS. 3 and 4, with the latch on the dial needle being in a tuck position with the old backing loop being located on the latch, the cylinder needles being in their fully upward position, with the hook of the dial needle capturing the pile yarn.

Referring next to FIG. 5 in contrast with FIG. 4, it may be seen that the dial needle 80 has continued to move in a distal direction to its tuck position, and the backing loop 96 is located nearly at the distal end of the latch 84, causing the latch 84 to move to its opened position. The cylinder needles 86 have moved into their fully distal (upward) or tuck position, where their hooks 88 are located above the dial needle 80 (by approximately 5.0 mm to 8.0 mm). When the dial needle 80 and the cylinder needles 86 are in their respective tuck positions, pile yarn 100 (also referred to as "face yarn") is inserted into the hook 82 of the dial needle 80.

Figure 6:
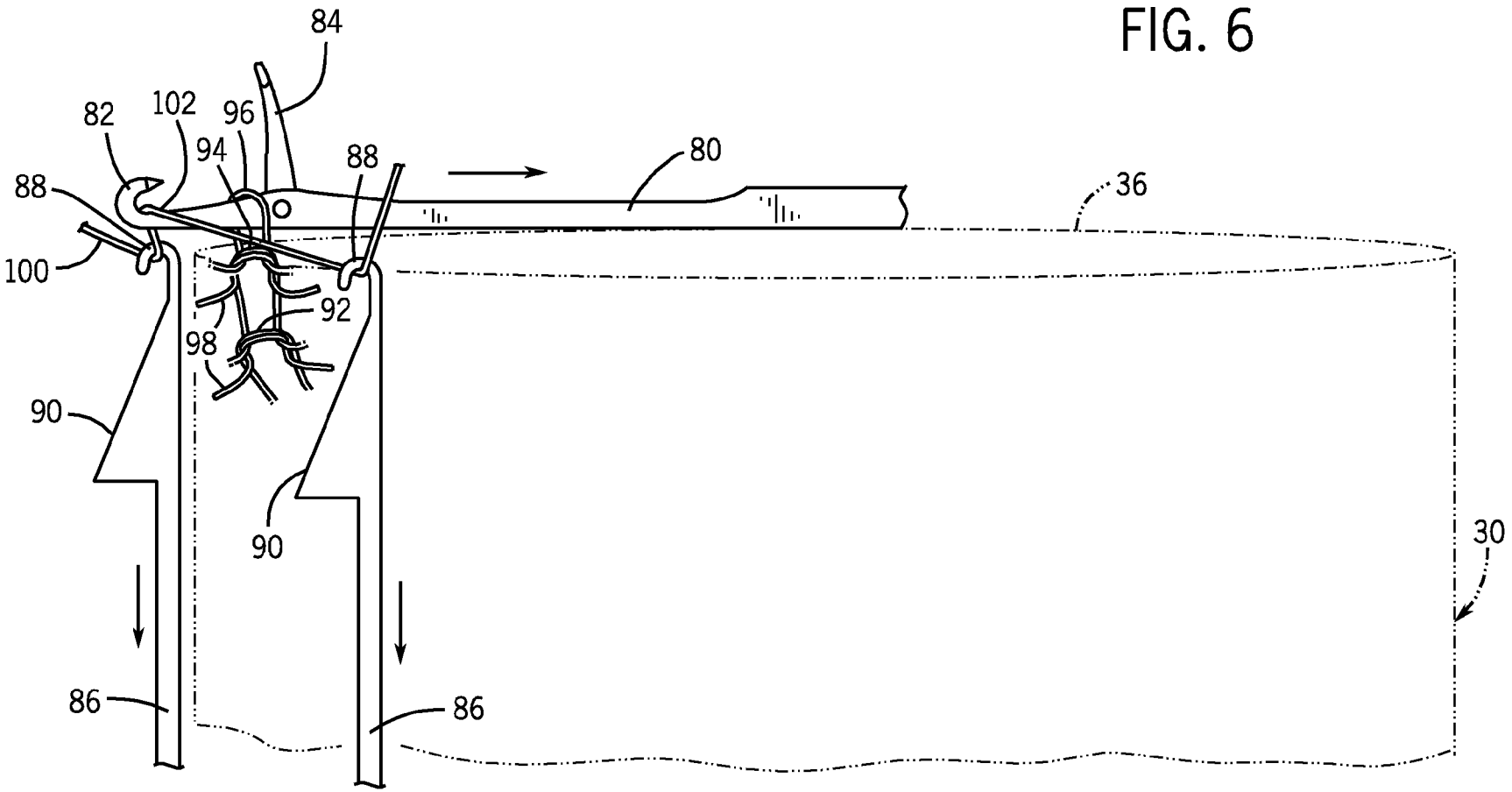
FIG. 6 is a schematic view of the dial needle and the cylinder needles and the tubular paint roller fabric shown in FIGS. 3 through 5, with the dial needle moving in a proximal direction and the cylinder needles moving in a downward direction, with the hooks of the dial needle and the cylinder needles capturing the pile yarn to form a new pile loop extending from the dial needle, and with the latch of the dial needle being closed by the old backing loop and the new pile loop as the dial needle moves in the proximal direction.

Referring next to FIG. 6 in contrast with FIG. 5, it may be seen that the dial needle 80 has moved in a proximal direction, pulling the pile yarn 100 into contact with the cylinder needles 86 just below their respective the hooks 88. As this occurs, the cylinder needles 86 begin to move downward, with the hooks 88 of the cylinder needles 86 drawing the pile yarn 100 downward on both sides of the dial needle 80, thereby beginning to create a new pile loop 102.

Figure 7:
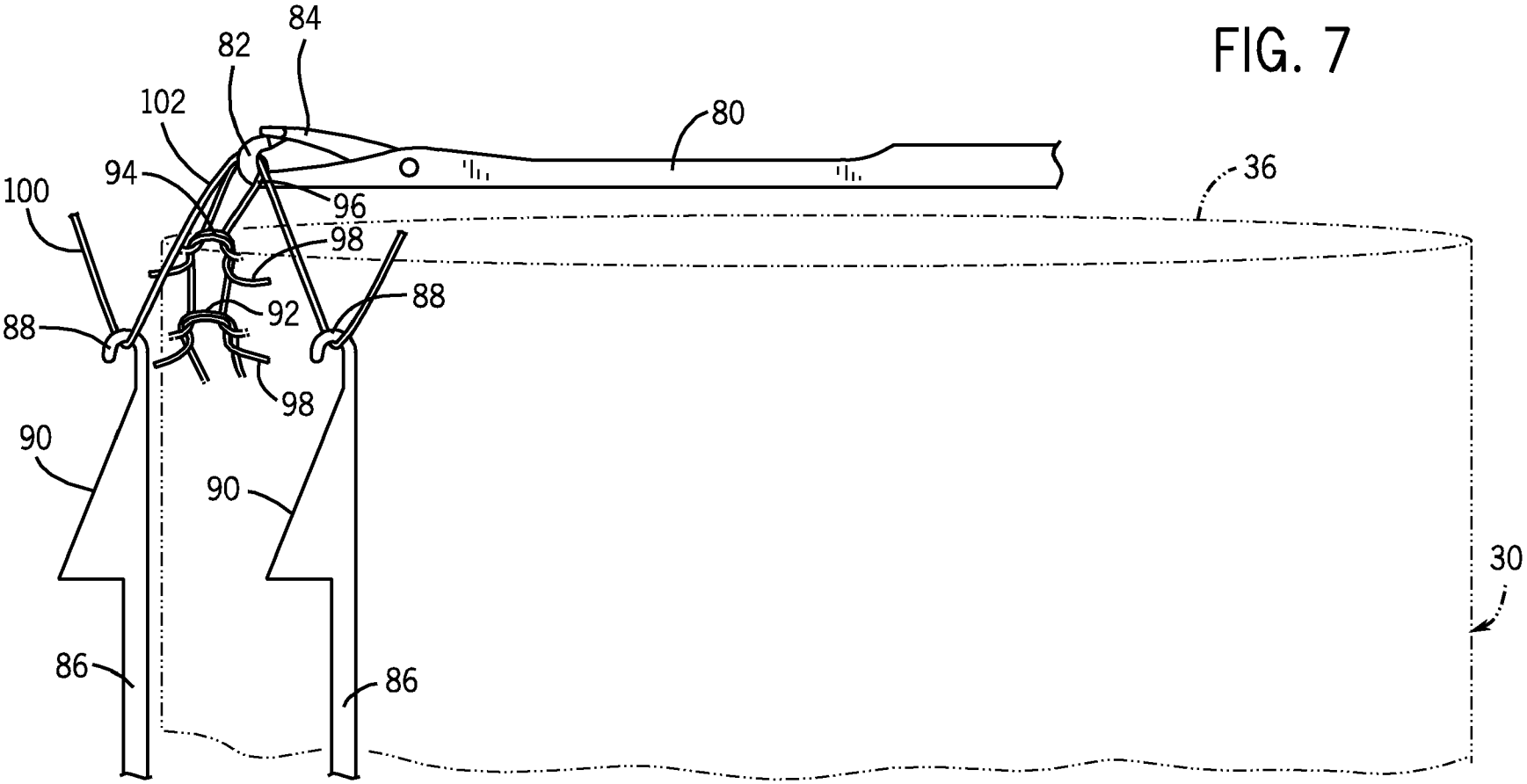
FIG. 7 is a schematic view of the dial needle and the cylinder needles and the tubular paint roller fabric shown in FIGS. 3 through 6, with the dial needle being in its resting position with regard to the old backing loop and the new pile loop thereupon and the cylinder needles being in their fully downward position to fully form the lower portions of the new pile loop.

Referring next to FIG. 7 in contrast with FIG. 6, it may be seen that the dial needle 80 has returned to its fully proximal or resting position, and the cylinder needles 86 have returned to their fully proximal or resting positions. Both the backing loop 96 and the new pile loop 102 are engaged by the hook 82 of the dial needle 80 (near the distal-most end of the dial needle 90) and the latch 84 is in its closed position with the distal end of the latch 84 adjacent the distal end of the hook 82. It should be noted that the length of the new pile loop 102 may be adjusted by raising or lowering the fully proximal or resting positions of the cylinder needles 86. This completes the first stage of the knitting process, and is the starting point for the second stage of the knitting process, which is shown in FIGS. 8 through 13.

Figure 8:
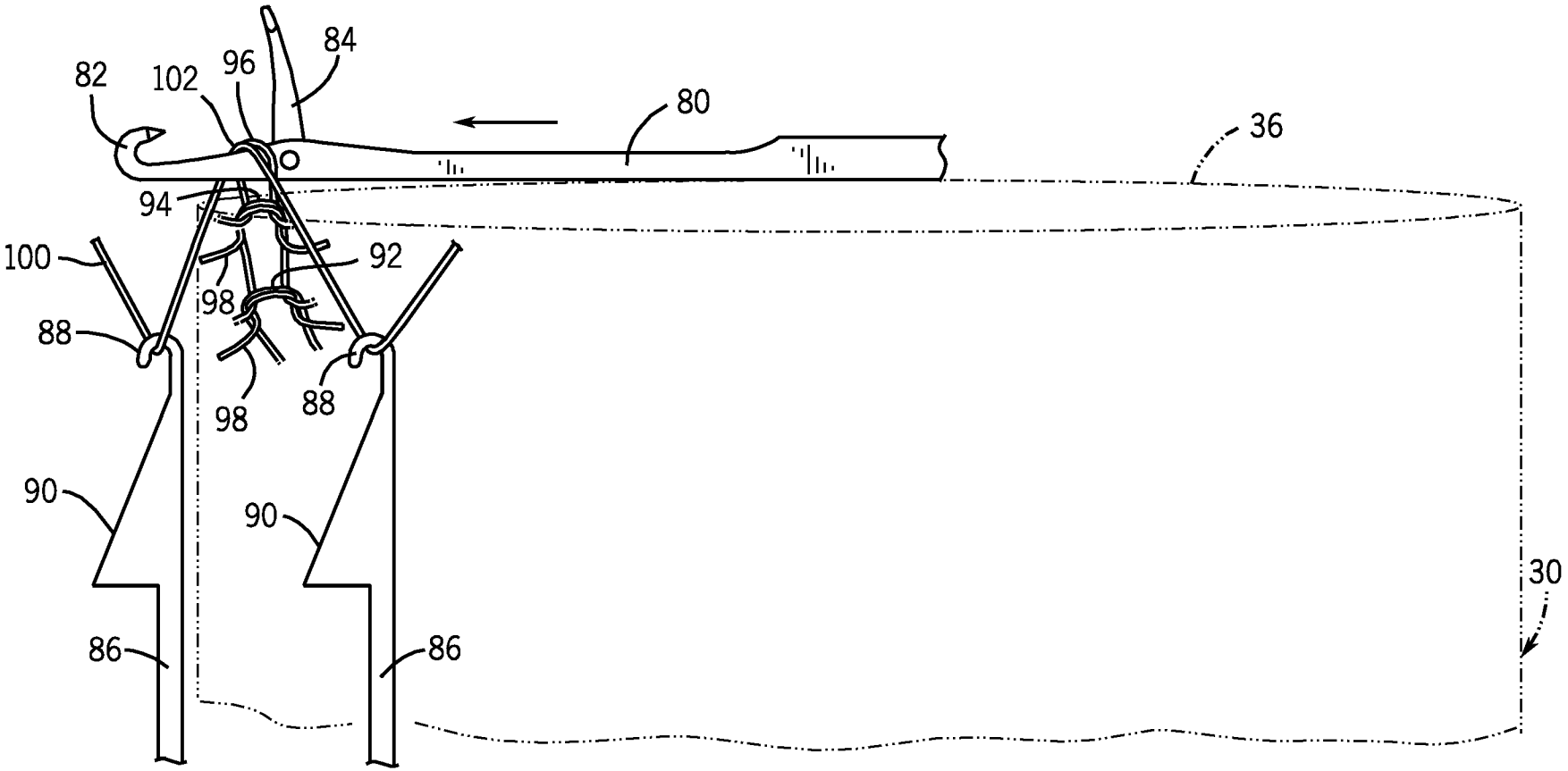
FIG. 8 is a schematic view of the dial needle and the cylinder needles and the tubular paint roller fabric shown in FIGS. 3 through 7, with the dial needle moving in a distal direction and the old backing loop and the new pile loop beginning to open the latch of the dial needle, and with the cylinder needles remaining in their fully downward position retaining the lower portions of the new pile loop.

Referring first to FIG. 8 in contrast with FIG. 7, it may be seen that the dial needle 80 has moved in a distal direction, and the backing loop 96 and the new pile loop 102 have begun to open the latch 84, causing the latch 84 to move to a position approximately midway between its closed and opened positions. Note that the backing loop 96 and the new pile loop 102 are adjacent the proximal end of the latch 84. The cylinder needles 86 remain in their fully proximal or resting position, as they will continue to do throughout the second stage of the knitting process.

Figure 9:
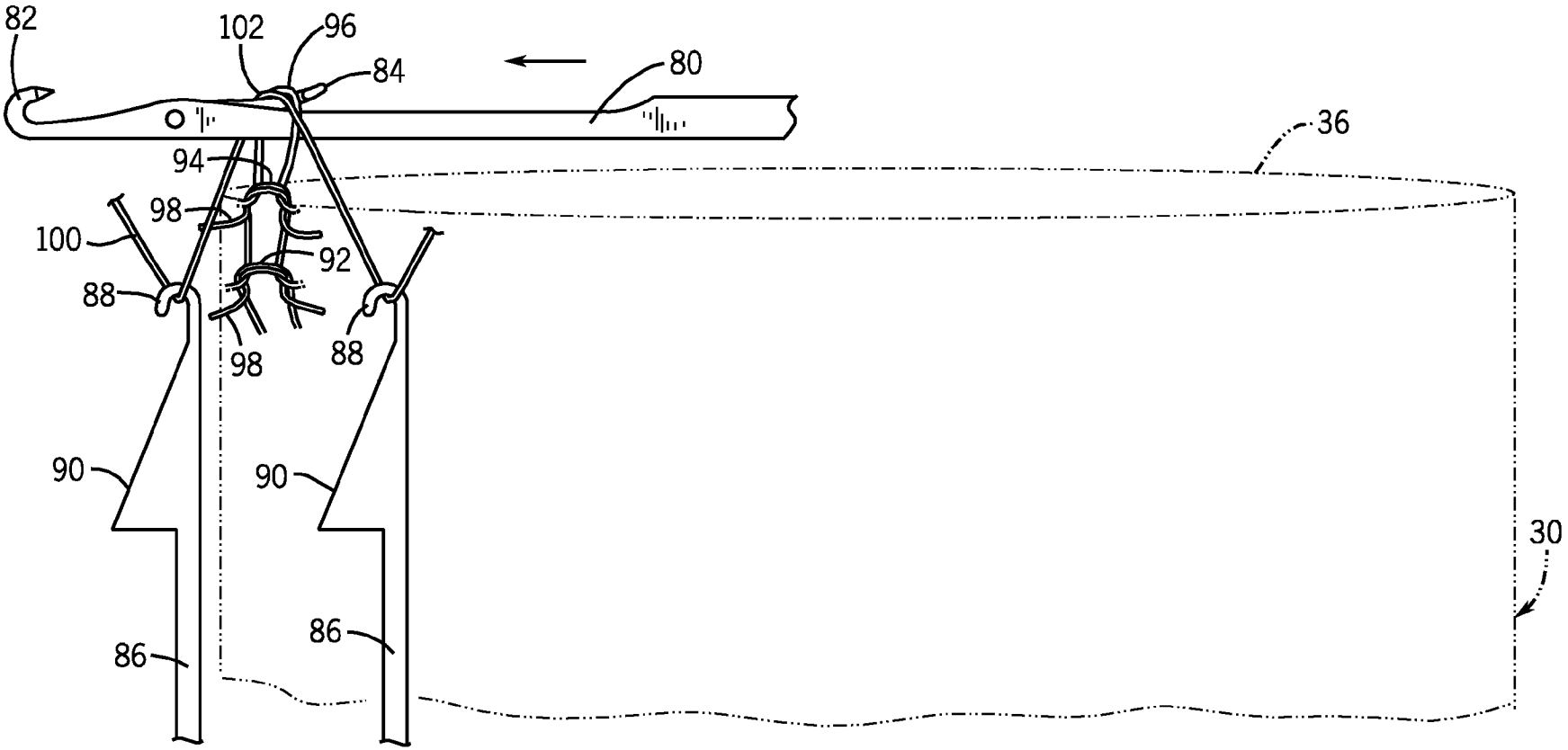
FIG. 9 is a schematic view of the dial needle and the cylinder needles and the tubular paint roller fabric shown in FIGS. 3 through 8, with the dial needle continuing to move in the distal direction and with the latch on the dial needle being in the tuck position with the old backing loop and the new pile loop being located on the latch of the needle, and with the cylinder needles remaining in their fully downward position retaining the lower portions of the new pile loop.

Referring now to FIG. 9 in contrast with FIG. 8, it may be seen that the dial needle 80 has continued to move in a distal direction, and the backing loop 96 and the new pile loop 102 are located nearly at the distal end of the latch 84, causing the latch 84 to move to its opened position. In this position, the backing loop 96 and the new pile loop 102 are about to fall off of the latch 84.

Figure 10:
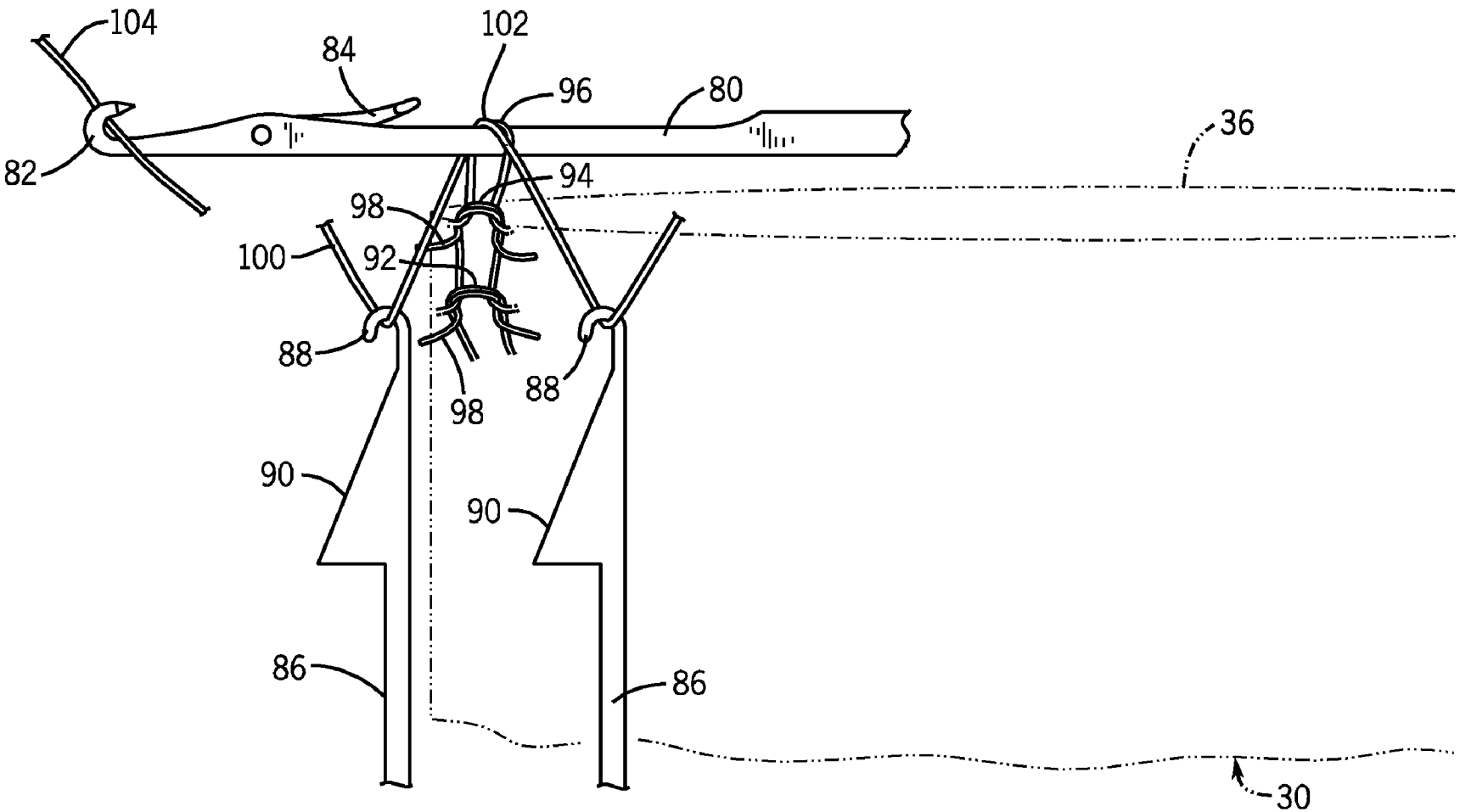
FIG. 10 is a schematic view of the dial needle and the cylinder needles and the tubular paint roller fabric shown in FIGS. 3 through 9, with the dial needle being in its fully distal position and the latch remaining in the tuck position with the old backing loop and the new pile loop having slipped over the end of the latch, and with the base yarn as it is engaged by the hook of the dial needle, with the cylinder needles remaining in their fully downward position retaining the lower portions of the new pile loop.

Referring next to FIG. 10 in contrast with FIG. 9, the dial needle 80 has moved to its fully distal or clearing position. With the dial needle 80 in its fully distal position, the backing loop 96 and the new pile loop 102 have slipped entirely off of the latch 84, and are located on the dial needle 80 in a position that is proximal to the latch 84. With the dial needle 80 in its clearing position, backing yarn 104 is inserted into the hook 82 of the dial needle 80.

Figure 11:
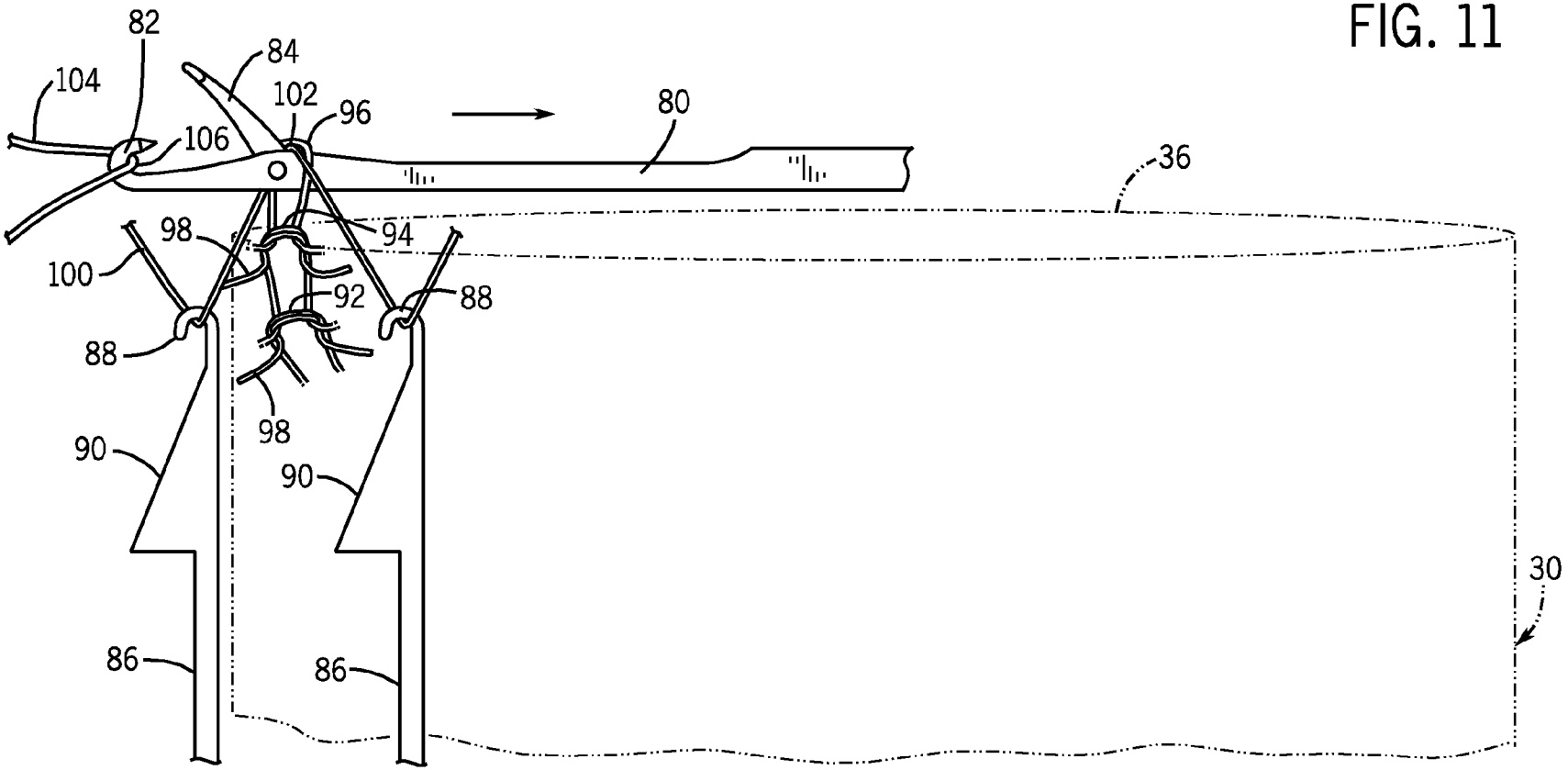
FIG. 11 is a schematic view of the dial needle and the cylinder needles and the tubular paint roller fabric shown in FIGS. 3 through 10, with the dial needle moving in a proximal direction and its hook capturing the base yarn to form a new backing loop in the vertical chain of backing loops, and with the latch being closed by the new cut pile loop and the old backing loop as the dial needle moves in the proximal direction, with the cylinder needles remaining in their fully downward position retaining the lower portions of the new pile loop.

Referring now to FIG. 11 in contrast with FIG. 10, it may be seen that the dial needle 80 has begun to move in a proximal direction with the hook 82 of the dial needle 80 drawing the backing yarn 104 proximally (radially inwardly) with respect to the tubular cut pile knit segment 30, thereby beginning to create a new backing loop 106. As the dial needle 80 moves distally, the new pile loop 102 and the backing loop 96 have moved in a distal direction on the dial needle 80 and have engaged the latch 84, causing it to move from its opened position toward its closed position (it is shown in FIG. 11 as having moved slightly past its midway position).

Figure 12:
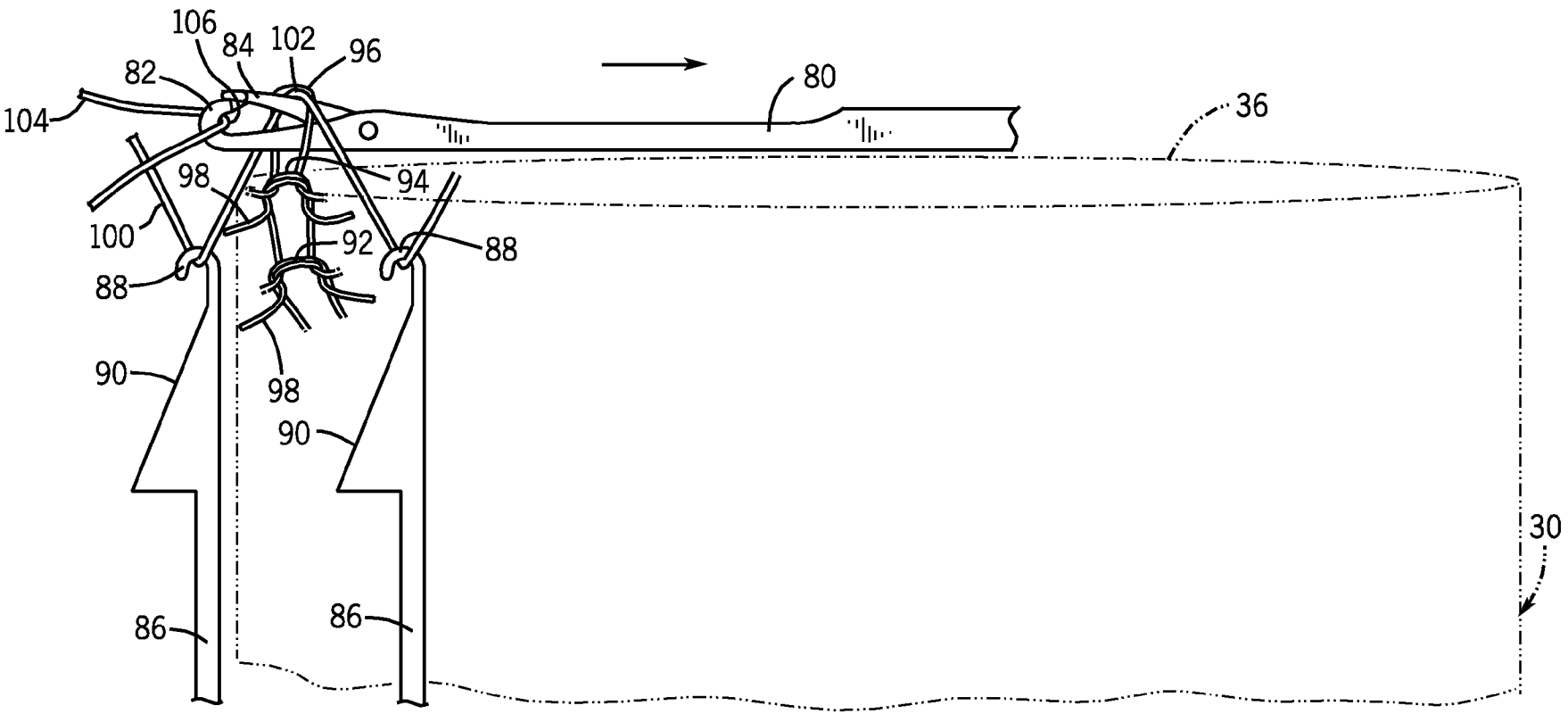
FIG. 12 is a schematic view of the dial needle and the cylinder needles and the tubular paint roller fabric shown in FIGS. 3 through 11, with the dial needle continuing to move in a proximal direction and its latch being completely closed by the new cut pile loop and the old backing loop as the dial needle moves in the proximal direction, with the cylinder needles remaining in their fully downward position retaining the lower portions of the new pile loop.

Referring next to FIG. 12 in contrast with FIG. 11, it may be seen that the dial needle 80 the new backing loop 106 of the backing yarn 104 still being located on the hook 82 of the dial needle 80. As the dial needle 80 has continued to move distally, the new pile loop 102 and the backing loop 96 have moved in a distal direction on the dial needle 80 and have begun to slide over the latch 84, which is now in its closed position. The fact that the latch 84 is closed also assists in retaining the new backing loop 106 of the backing yarn 104 on the hook 82 of the dial needle 80.

Figure 13:
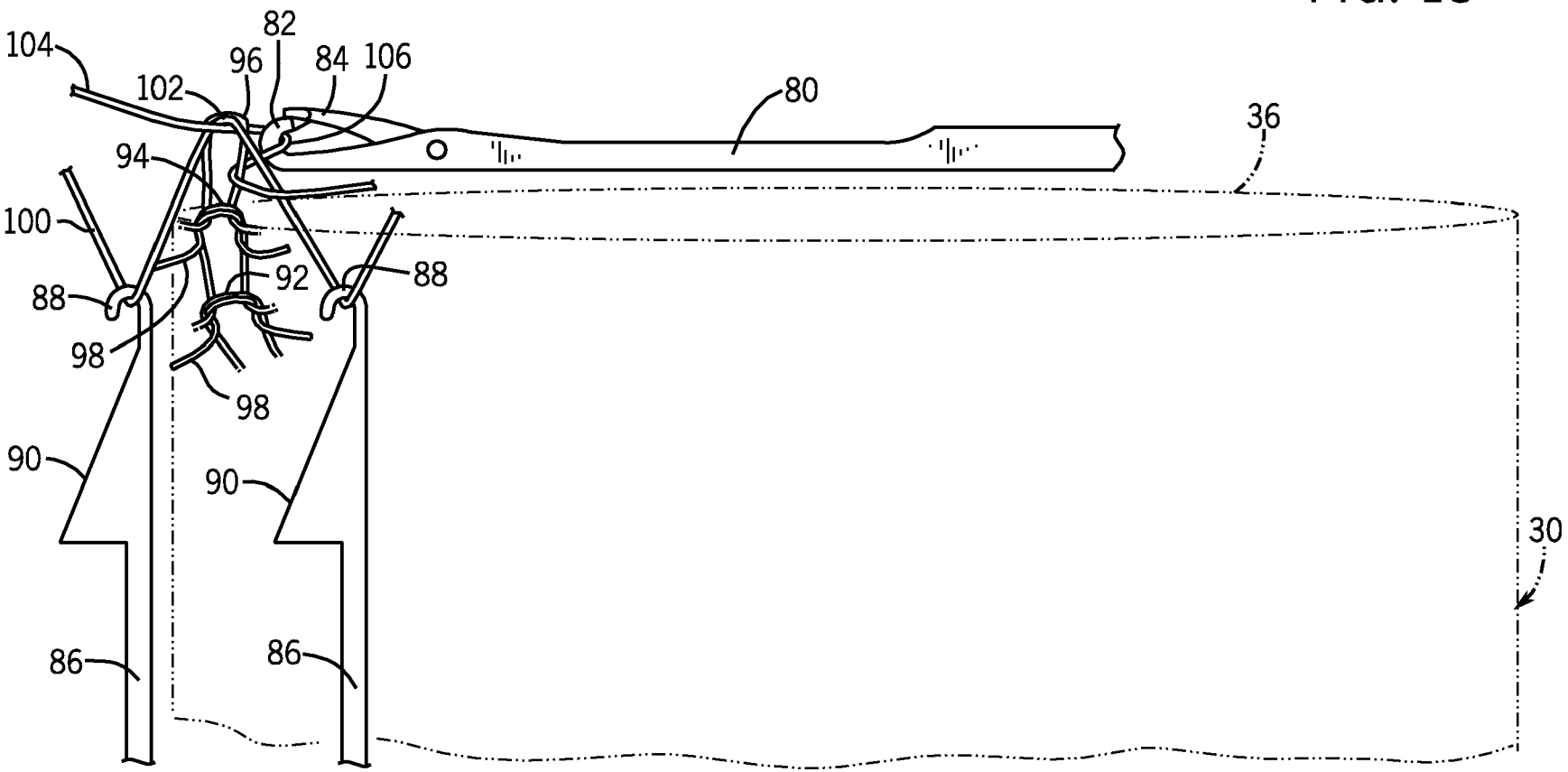
FIG. 13 is a schematic view of the knitting needle and the tubular paint roller fabric shown in FIGS. 3 through 12, with the dial needle in its fully proximal direction and with the new pile loop and the old backing loop having been cast off and the new backing loop having been formed, with the cylinder needles remaining in their fully downward position retaining the lower portions of the new pile loop.

Referring next to FIG. 13 in contrast with FIG. 12, it may be seen that the dial needle 80 has moved to its fully proximal or resting direction, and has pulled the new backing loop 106 of the backing yarn 104 through the new pile loop 102 and the backing loop 96. As this happened, the new pile loop 102 and the backing loop 96 slipped off of the latch 84 and over the hook 82 of the dial needle 80; this is referred as the new pile loop 102 and the backing loop 96 having been "cast off" the dial needle 80. Thus, the new backing loop 106 has been knitted through the new pile loop 102 and the backing loop 96, thereby locking the new pile loop 102 into the tubular cut pile knit segment 30. Thus, the tubular cut pile knit segment 30 is knitted with the new pile loop 102 extending outwardly. This completes the second stage of the knitting process, and is the starting point for the third stage of the knitting process, which is shown in FIGS. 14 and 15.

Figure 14:
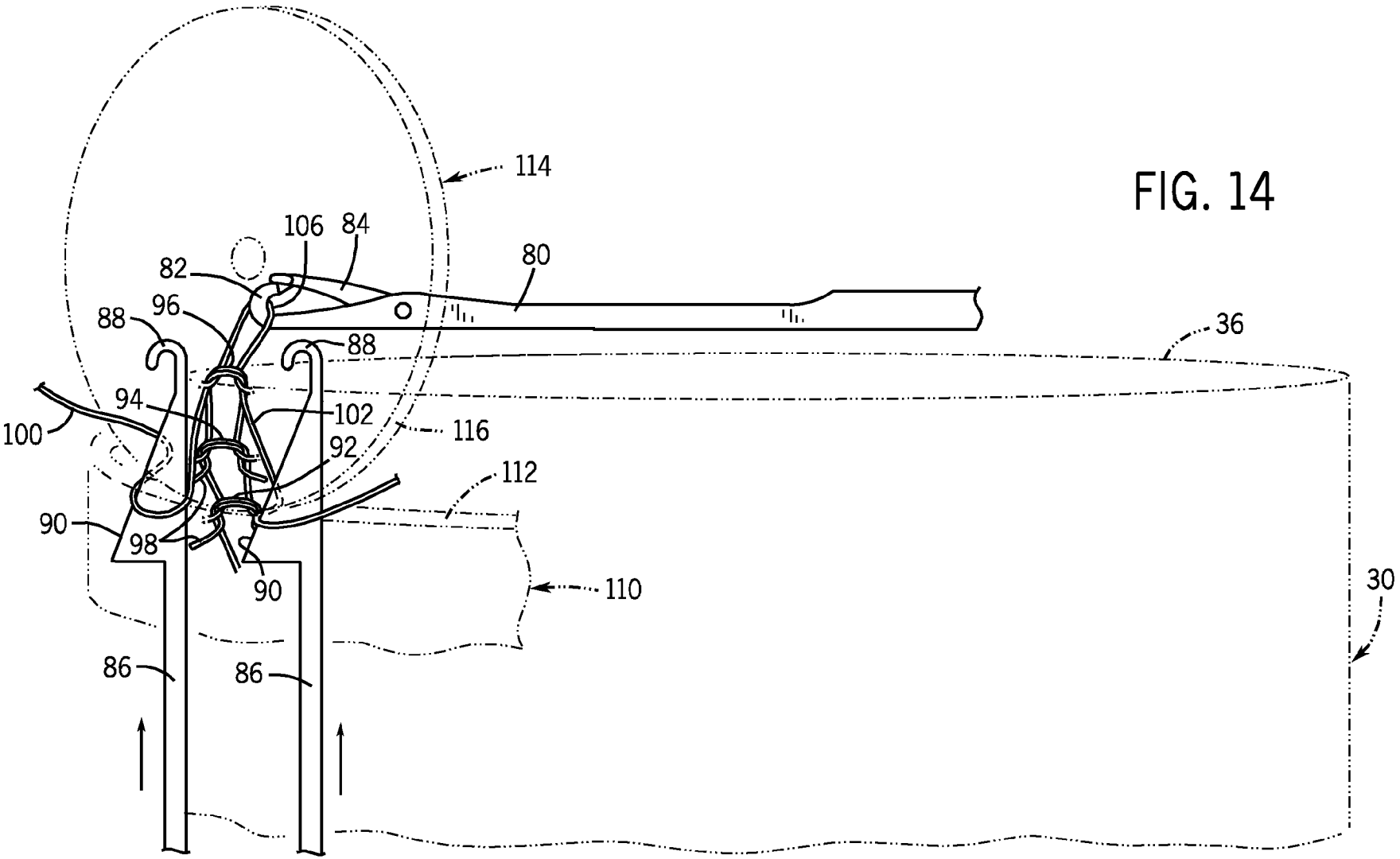
FIG. 14 is a schematic view of the dial needle and the cylinder needles and the tubular paint roller fabric shown in FIGS. 3 through 13, with the dial needle remaining in its resting position and a cutting wheel engaging the top edge of a cylinder to pinch the pile yarn forming the ends of the new pile loop therebetween as the cylinder needles move upward to cut the new pile loop.

Referring first to FIG. 14 in contrast with FIG. 13, it may be seen that a cylinder 110 is schematically illustrated with an upwardly facing top edge 112. The top edge 112 of the cylinder 110 is located between the cylinder needles 86 and the tubular cut pile knit segment 30 (although it will be understood by those skilled in the art that the cylinder needles 86 are installed with their distal portions both mounted in and operated by the cylinder 110). Located above the top edge 112 of the cylinder the pile yarn 100 is a yarn cutting roll 114 having an outer edge 116 that contacts the top edge 112 of the cylinder to pinch the portions of the pile yarn 100 that will comprise the ends of the new pile loop 102 therebetween. As this occurs, the cylinder needles 86 move in a distal (upward) direction such that their the tapered cutting edges 90 cut the new pile loop 102 free from the pile yarn 100. (Note that the cutting roll 114 itself does not do any cutting; rather, it only holds the pile yarn 100 in place while the cylinder needles 86 move to cause the tapered cutting edges 90 to cut the pile yarn 100.)

Figure 15:
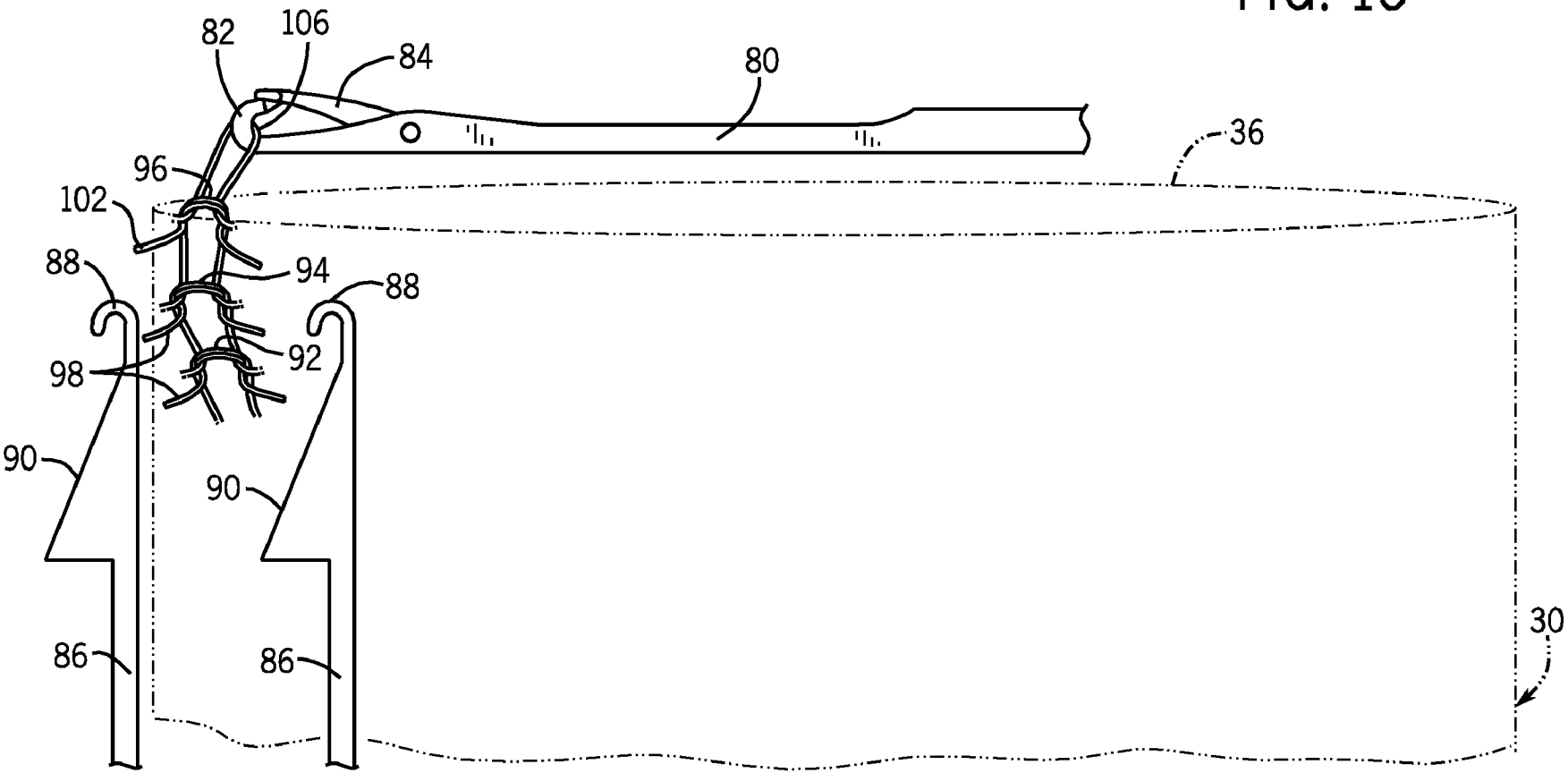
FIG. 15 is a schematic view of the dial needle and the cylinder needles and the tubular paint roller fabric shown in FIGS. 3 through 14, with the new pile loop having been cut from the pile yarn at both ends thereof, with the dial needle remaining in its resting position and the cylinder needles having returned to their fully downward position.

Referring finally to FIG. 15 in contrast with FIG. 14, it may be seen that the new pile loop 102 is locked in place in the tubular cut pile knit segment 30 by the new backing loop 106, which has been knitted through the new pile loop 102 and the backing loop 96. By reviewing the operation described in FIGS. 3 through 15, which occurs repeatedly, it may thus be appreciated that the tubular cut pile knit segment 30 is knitted with its cut pile segments 34 extending outwardly.

Those skilled in the art will appreciate that while the process shown in FIGS. 3 through 15 has been depicted with only a single dial needle 80 and two cylinder needles 86, a plurality of alternating dial needles and cylinder needles will be used, all located, oriented, and moving in a manner similar to that described with reference to the dial needle 80 and the cylinder needles 86. In the preferred embodiment, between forty and one hundred of each of the dial needles 80 and the cylinder needles 86 will be used, with the currently preferred embodiment having approximately fifty-six of each of the dial needles 80 and the cylinder needles 86. It will be appreciated by those skilled in the art that the number of wales produced by a circular knitting machine is the same as the number of dial needles 80 used by the circular knitting machine.

A wide variety of materials may be used to knit the tubular cut pile knit segment 30, and the tubular cut pile knit paint roller cover fabric of the present invention may be made of virtually any of the materials used in cut pile knit fabrics in the past. For example, the backing and pile face yarns may each be made of natural or synthetic yarn fibers, or a blend of natural and synthetic fibers in the yarn. Natural fibers used in the backing and pile face may be, for example, wool. Synthetic fibers used in the knit base may be, for example, polyester, acrylic, polypropylene, aramid, and spandex, or a blend of any of the aforementioned. Synthetic fiber yarns used in the pile face may be, for example, polyester, acrylic, nylon, modacrylic, rayon, polypropylene, and aramid, or a blend of any of the aforementioned. The backing yarn may optionally be made at least in part of a low melt material, such as the yarn used for the base in the above-incorporated by reference U.S. Pat. No. 6,766,668, to Sinykin. Yarn deniers for both the backing and pile face may be between approximately seventy-five and approximately one thousand five hundred, although yarns outside these ranges may be useable as well. The pile face yarn may use yarns ranging from microdenier fibers to polyamide fibers.

Figure 16:
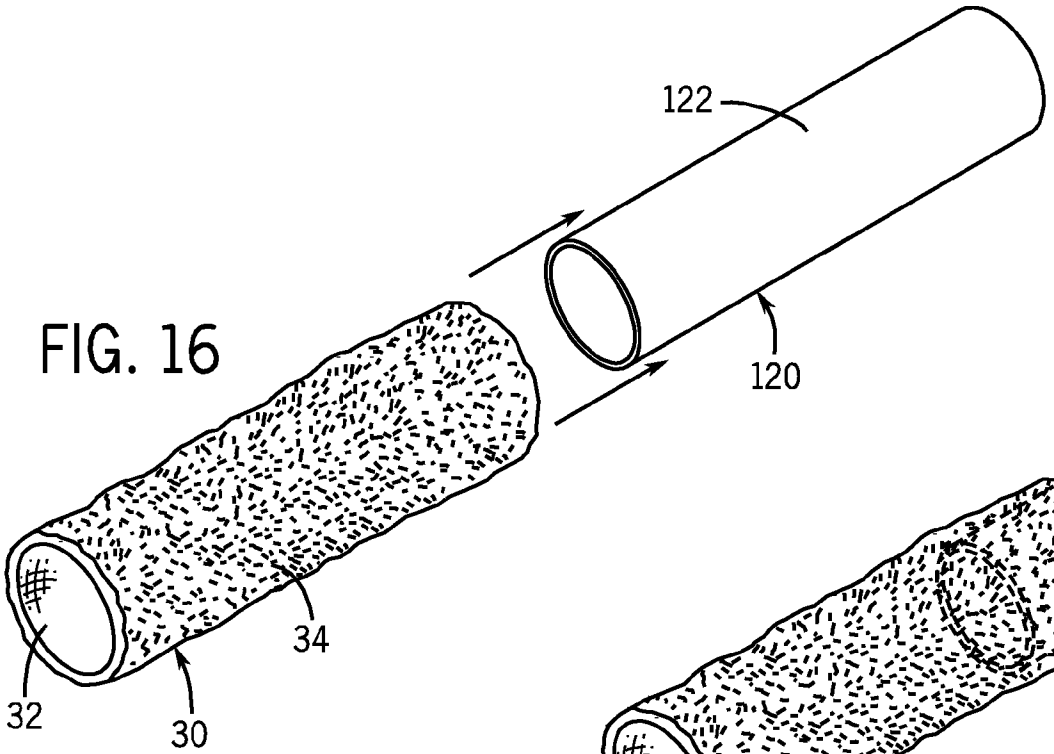
FIG. 16 is a schematic isometric depiction showing an end of a tubular paint roller cover fabric illustrated in FIG. 1 about to be slid onto the outer surface of a core member over an adhesive located on the outer surface of the core member.
Figure 17:
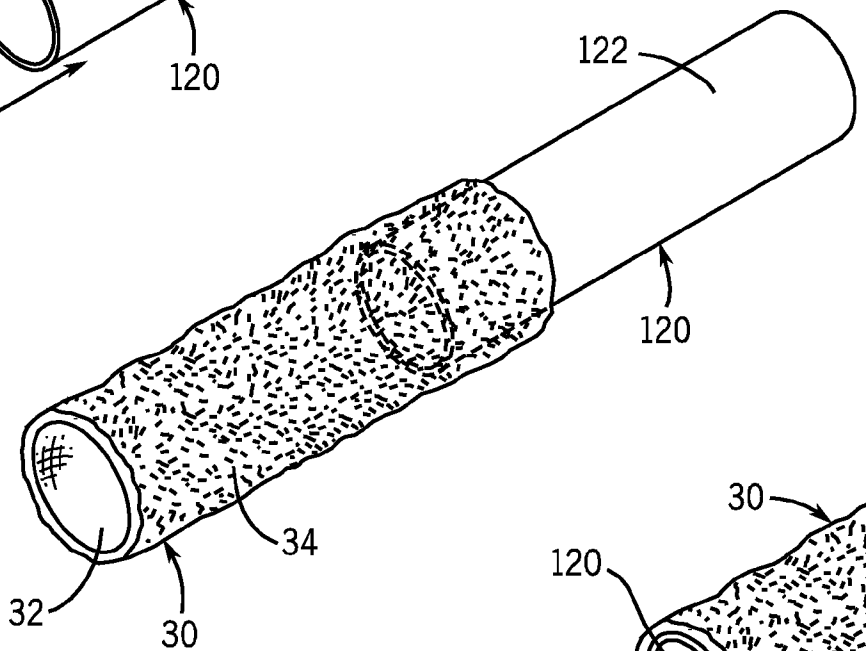
FIG. 17 is a schematic isometric depiction of the tubular paint roller cover fabric and the adhesive-covered core member shown in FIG. 16, with the tubular paint roller cover fabric being partially slid onto the outer surface of the core member.
Figure 18:
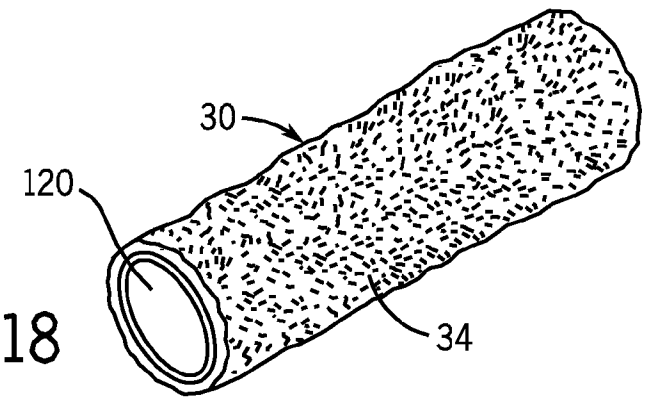
FIG. 18 is a schematic isometric depiction of the tubular paint roller cover fabric and the adhesive-covered core member shown in FIGS. 16 and 17, with the tubular paint roller cover fabric now covering the entire outer surface of the adhesive-covered core member.

Moving now to FIGS. 16 through 18, the installation of the tubular cut pile knit segment 30 onto a paint roller cover core 120 is schematically illustrated. The installation method depicted in FIGS. 16 through 18 is fully disclosed in copending U.S. patent application Ser. No. 12/100,050, filed on Apr. 9, 2008, entitled "Method of Manufacturing Paint Roller Covers From a Tubular Fabric Sleeve," which patent application is assigned to the assignee of the present invention, and which patent application is hereby incorporated herein by reference in its entirety. Alternately, other installation methods can be used as well, including those disclosed in copending U.S. patent application Ser. No. 12/015,612, filed on Jan. 17, 2008, entitled "Method of Manufacturing Paint Roller Covers From a Tubular Fabric Sleeve," which patent application is assigned to the assignee of the present invention, and which patent application is hereby incorporated herein by reference in its entirety.

It will be appreciated by those skilled in the art that the paint roller cover core 120 may constitute plastic tubular core stock that has been cut to single paint roller size (typically nine inches (229 millimeters)). (Alternately, it may be cut to a longer length, such as, for example, sixty-four inches (1625 millimeters); if such a longer length is used, following installation of the tubular cut pile knit segment 30 onto the plastic tubular core stock, it may be cut into the desired size shorter paint roller covers, such as, for example, seven nine inch (229 millimeters) paint roller covers.) Finishing the paint roller covers typically will include the steps of combing the cut pile knit fabric on the paint roller cover and shearing the cut pile knit fabric to the desired length. These finishing steps may occur either before or after cutting longer segments to the desired length. Finally, the edges of the paint roller covers are beveled, and any loose yarn fibers may be vacuumed off.

Referring now to FIG. 16, the paint roller cover core 120 covered with a non-tacky adhesive 122 is illustrated. The tubular cut pile knit segment 30 is shown as it is about to be pulled onto the exterior surface of the paint roller cover core 120. The tubular cut pile knit segment 30 has an inner diameter that is approximately the same size as or slightly smaller than the outer diameter of the paint roller cover core 120, which outer diameter is typically approximately one and five-eighths inches (41 millimeters) to one and three-quarters inches (44 millimeters) (the inner diameter of the core member 90 is approximately one and one-half inches (38 millimeters), although alternative sizes such as inner diameters of one and three-quarters inches (44 millimeters) and two inches (51 millimeters) could be used as well). The tubular cut pile knit segment 30 may be sized to require that it be stretched slightly when it is placed onto the paint roller cover core 120 in order to achieve the correct density and/or positioning. Alternately, the tubular cut pile knit segment 30 could also be slightly larger than the outer diameter of the paint roller cover core 120 onto which it is to be installed and shrunk slightly to closely fit the paint roller cover core 120.

The tubular cut pile knit segment 30 is of a length that corresponds to the length of the paint roller cover core 120. For purposes of the example discussed herein, it will be assumed that the paint roller cover core 120 is approximately nine inches (229 millimeters) long and that the tubular cut pile knit segment 30 is approximately nine to nine and one-quarter inches (235 millimeters) long, which are lengths that are selected to allow the paint roller cover core 120 and the tubular cut pile knit segment 30 to be used for the manufacture of a single nine inch (229 millimeter) long paint roller cover. It will be appreciated by those skilled in the art that the paint roller cover core 120 and the tubular cut pile knit segment 30 could alternately be sized for use in manufacturing a plurality of paint roller covers of any of several different lengths. For example, the paint roller cover core 120 and the tubular cut pile knit segment 30 could each be approximately sixty-four inches (1625 millimeters) long, which is a sufficient length to allow them to be used for the manufacture of seven nine inch (229 millimeter) long paint roller covers.

Since inner diameter of the tubular cut pile knit segment 30 is approximately the same as the paint roller cover core 120, the tubular cut pile knit segment 30 need not be capable of substantial stretching when it is pulled onto the paint roller cover core 120. The tubular cut pile knit segment 30 taught herein is resilient and will closely fit the outer diameter of the paint roller cover core 120.

In FIG. 16, the tubular cut pile knit segment 30 is shown about to be pulled over the paint roller cover core 120. FIG. 17 shows the tubular cut pile knit segment 30 partly pulled onto the paint roller cover core 120, and FIG. 18 shows the tubular cut pile knit segment 30 fully pulled onto the paint roller cover core 120. The tubular cut pile knit segment 30 is subsequently adhesively secured to the paint roller cover core 120 by the application of heat to cause the non-tacky adhesive 122 melt, thereby adhering the tubular cut pile knit segment 30 the paint roller cover core 120, as fully described in U.S. patent application Ser. No. 12/100,050, filed on Apr. 9, 2008.

Finishing the paint roller covers will include the steps of combing the cut pile on the paint roller cover and shearing the cut pile knit fabric to the desired length. Finally, the edges of the paint roller covers are beveled, and any loose yarn fibers may be vacuumed off.

It may therefore be appreciated from the above detailed description of the preferred embodiment of the present invention that it provides a tubular cut pile knit paint roller cover fabric that is suitable for use in the manufacture of a paint roller cover. The tubular cut pile knit paint roller cover fabric of the present invention is manufactured with the pile side facing outwardly rather than inwardly, thereby obviating the need to invert it prior to mounting it on a paint roller cover core. The tubular cut pile knit paint roller cover fabric of the present invention is of a size suitable for mounting on a paint roller cover core in a seamless manner, without cutting it except for cutting it to a length fitting the length of paint roller cover core material on which the tubular cut pile knit paint roller cover fabric is to be mounted.

The tubular cut pile knit paint roller cover fabric of the present invention is well suitable for use in its application on a paint roller cover, and will not experience any significant degradation of the tubular cut pile knit paint roller cover fabric due to its contact with a wide variety of paints, enamels, stains, etc. The tubular cut pile knit paint roller cover fabric of the present invention is manufactured in a manner in which the pile loops are securely retained by the knit base material such that the shedding of pile fibers from the tubular cut pile knit paint roller cover fabric is minimized. The tubular cut pile knit paint roller cover fabric of the present invention is also manufacturable in extended length segments that may later be cut to tubular segments of any desired length.

The tubular cut pile knit paint roller cover fabric of the present invention is of a construction which is both durable and long lasting when it has been secured to a paint roller cover core, and the resulting paint roller cover will provide the user with an acceptably long lifetime. The tubular cut pile knit paint roller cover fabric of the present invention is also inexpensive to manufacture, thereby enhancing its market appeal and to affording it the broadest possible market. Finally, all of the aforesaid advantages and objectives of the tubular cut pile knit paint roller cover fabric of the present invention are achieved without incurring any substantial relative disadvantage.

Although the foregoing description of the tubular cut pile knit paint roller cover of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A knit pile fabric suitable for use on paint roller covers, said knit pile fabric comprising:

an uninverted knitted base fabric having a tubular configuration defining an outside and an inside, said base fabric having a predetermined number of wales located adjacent each other and arranged around the circumference of said base fabric, said base fabric having successive courses each of which is knit after a preceding course, said base fabric comprising a plurality of loops, wherein each loop in any particular wale is knitted through a loop in the preceding course in said particular wale from the outside to the inside of said tubular configuration of said base fabric; and a plurality of cut pile segments, each of said cut pile segments having opposite ends with a loop portion located therebetween, said loop portion of each of said plurality of cut pile segments being knitted together with a loop of said base fabric into said base fabric, said opposite ends of said plurality of cut pile segments extending outwardly from said base fabric and forming the pile of said knit fabric.

2. A knit pile fabric as defined in claim 1, wherein said base fabric and said pile are knitted from yarns made of natural or synthetic yarn fibers, or a blend of natural and synthetic fibers.

3. A knit pile fabric as defined in claim 2, wherein said yarns have a denier of between seventy-five and one thousand five hundred.

4. A knit pile fabric as defined in claim 2, wherein the yarn used for said base fabric is made of wool, polyester, acrylic, polypropylene, aramid, spandex, or a blend of any of the aforementioned.

5. A knit pile fabric as defined in claim 2, wherein the yarn used for said cut pile segments is made of wool, polyester, acrylic, nylon, modacrylic, rayon, polypropylene, aramid, or a blend of any of the aforementioned.

6. A knit pile fabric as defined in claim 1, wherein said cut pile segments have a pile height of between approximately one-quarter inch and approximately three inches.

7. A knit pile fabric as defined in claim 1, wherein the number of wales in said tubular configuration base fabric is between approximately forty and approximately one hundred.

8. A knit pile fabric as defined in claim 7, wherein the number of wales in said tubular configuration base fabric is approximately fifty-six.

9. A knit pile fabric as defined in claim 1, wherein said tubular configuration base fabric has an inner diameter of approximately five inches or less.

10. A knit pile fabric as defined in claim 9, wherein said tubular configuration base fabric has an inner diameter that is approximately the same size as the outer diameter of a paint roller cover core.

11. A knit pile fabric as defined in claim 10, wherein said tubular configuration base fabric has an inner diameter of approximately one and one-half inches.

12. A knit pile fabric as defined in claim 1, wherein said tubular configuration base fabric is manufactured in an extended length that is substantially longer than the length of a paint roller.

13. A paint roller cover made in part from a knit pile fabric as defined in claim 1, said paint roller cover comprising:

a hollow cylindrical paint roller cover core; and a segment of said tubular configuration base fabric secured to the outside surface of said paint roller cover core.

14. A paint roller cover as defined in claim 13, wherein said tubular configuration base fabric is secured to the outside surface of said paint roller cover core using an adhesive.

15. A paint roller cover as defined in claim 13, wherein said tubular configuration base fabric is combed and sheared to the desired length after said segment of said tubular configuration base fabric is secured to the outside surface of said paint roller cover core.

16. A paint roller cover as defined in claim 15, wherein said tubular configuration base fabric is also beveled and vacuumed after said segment of said tubular configuration base fabric is secured to the outside surface of said paint roller cover core.

17. A knit pile fabric suitable for use on paint roller covers, said knit pile fabric comprising:

an uninverted knitted base fabric having a tubular configuration defining an outside and an inside, said base fabric having wales located adjacent each other and arranged around the circumference of said base fabric, said base fabric also having successive courses each of which is knit after a preceding course, said base fabric comprising a plurality of loops, wherein each loop in any particular wale is knitted through a loop in the preceding course in said particular wale; and a plurality of cut pile segments, each of said cut pile segments being knitted together with a loop of said base fabric into said base fabric with the ends of said cut pile segments extending outwardly from said base fabric and forming the pile of said knit fabric.

18. A knit pile fabric suitable for use on paint roller covers, said knit pile fabric comprising:

an uninverted knitted base fabric having a tubular configuration defining an outside and an inside, said base fabric having between forty and one hundred wales located adjacent each other and arranged around the circumference of said base fabric, said base fabric having successive courses each of which is knit after a preceding course, said base fabric comprising a plurality of loops, wherein each loop in any particular wale is knitted through a loop in the preceding course in said particular wale from the outside to the inside of said tubular configuration of said base fabric; wherein said tubular configuration base fabric has an inner diameter that is approximately the same size as the outer diameter of a paint roller cover core; and a plurality of cut pile segments, each of said cut pile segments having opposite ends with a loop portion located therebetween, said loop portion of each of said plurality of cut pile segments being knitted together with a loop of said base fabric into said base fabric, said opposite ends of said plurality of cut pile segments extending outwardly from said base fabric and forming the pile of said knit fabric, wherein said cut pile segments have a pile height of between approximately one-quarter inch and approximately three inches.

19. A method of making a knit pile fabric comprising:

knitting a base fabric in a tubular configuration defining an outside and an inside, said base fabric having a predetermined number of wales located adjacent each other and arranged around the circumference of said base fabric, said base fabric having successive courses each of which is knit after a preceding course, said base fabric comprising a plurality of loops, wherein each loop in any particular wale is knitted through a loop in the preceding course in said particular wale from the outside to the inside of said tubular configuration of said base fabric;

providing a plurality of cut pile segments, each of said cut pile segments having opposite ends with a loop portion located therebetween; and knitting said loop portion of each of said cut pile segments together with a loop of said base fabric into said base fabric, said opposite ends of said plurality of cut pile segments extending outwardly from said base fabric and forming the pile of said knit fabric.

20. A method as defined in claim 19, wherein said base fabric and said pile are knitted from yarns made of natural or synthetic yarn fibers, or a blend of natural and synthetic fibers.

21. A method as defined in claim 20, wherein said yarns have a denier of between seventy-five and one thousand five hundred.

22. A method as defined in claim 20, wherein the yarn used for said base fabric is made of wool, polyester, acrylic, polypropylene, aramid, spandex, or a blend of any of the aforementioned.

23. A method as defined in claim 20, wherein the yarn used for said cut pile segments is made of wool, polyester, acrylic, nylon, modacrylic, rayon, polypropylene, aramid, or a blend of any of the aforementioned.

24. A method as defined in claim 19, wherein said cut pile segments have a pile height of between approximately one-quarter inch and approximately three inches.

25. A method as defined in claim 19, wherein the number of wales in said tubular configuration base fabric is between approximately forty and approximately one hundred.

26. A method as defined in claim 25, wherein the number of wales in said tubular configuration base fabric is approximately fifty-six.

27. A method as defined in claim 19, wherein said tubular configuration base fabric has an inner diameter of approximately five inches or less.

28. A method as defined in claim 27, wherein said tubular configuration base fabric has an inner diameter that is approximately the same size as the outer diameter of a paint roller cover core.

29. A method as defined in claim 28, wherein said tubular configuration base fabric has an inner diameter of approximately one and one-half inches.

30. A method as defined in claim 29, wherein said tubular configuration base fabric is manufactured in an extended length that is substantially longer than the length of a paint roller.

* * * * *